US007956832B2

(12) United States Patent
Tanaka et al.

(10) Patent No.: US 7,956,832 B2
(45) Date of Patent: Jun. 7, 2011

(54) LIQUID CRYSTAL DISPLAY DEVICE

(75) Inventors: Yukio Tanaka, Kanazawa (JP); Tetsuo Fukami, Ishikawa-gun (JP)

(73) Assignee: Toshiba Matsushita Display Technology Co., Ltd., Tokyo (JP)

( * ) Notice: Subject to any disclaimer, the term of this patent is extended or adjusted under 35 U.S.C. 154(b) by 943 days.

(21) Appl. No.: 11/773,832

(22) Filed: Jul. 5, 2007

(65) Prior Publication Data

US 2008/0024404 A1 Jan. 31, 2008

(30) Foreign Application Priority Data

Jul. 5, 2006 (JP) ..... 2006-185812

(51) Int. Cl.
*G09G 3/36* (2006.01)

(52) U.S. Cl. ..... 345/87; 345/99; 345/204; 345/211; 345/213

(58) Field of Classification Search ..... 345/87–100, 345/204–215
See application file for complete search history.

(56) References Cited

U.S. PATENT DOCUMENTS

| | | | | |
|---|---|---|---|---|
| 6,753,835 | B1 * | 6/2004 | Sakai | 345/87 |
| 7,742,019 | B2 * | 6/2010 | Takahara | 345/76 |
| 2004/0041766 | A1 * | 3/2004 | Nakao et al. | 345/89 |
| 2005/0168490 | A1 * | 8/2005 | Takahara | 345/690 |
| 2006/0092111 | A1 | 5/2006 | Nakao et al. | |

FOREIGN PATENT DOCUMENTS

| | | |
|---|---|---|
| JP | 2002-202491 | 7/2002 |
| JP | 2003-280036 | 10/2003 |

OTHER PUBLICATIONS

U.S. Appl. No. 12/771,191, filed Apr. 30, 2010, Tanaka, et al.
U.S. Appl. No. 11/781,441, filed Jul. 23, 2007, Fukami, et al.
U.S. Appl. No. 12/877,551, filed Sep. 8, 2010, Tanaka et al.

* cited by examiner

*Primary Examiner* — Vijay Shankar
(74) *Attorney, Agent, or Firm* — Oblon, Spivak, McClelland, Maier & Neustadt, L.L.P.

(57) ABSTRACT

A liquid crystal display device includes a liquid crystal display panel DP in which liquid crystal pixels PX are connected to a source line X via pixel switching elements, and a display control circuit CNT which performs non-video signal writing for driving the source line X according to a non-video signal and applying the potential of the source line X to one of the liquid crystal pixels PX via a selected one of the pixel switching elements T and performs video signal writing for driving the source line X according to a video signal and applying the potential of the source line X to one of the liquid crystal pixels PX via a selected one of the pixel switching elements T. The display control circuit CNT is configured to provide a precharge period between a non-video signal writing period in which the non-video signal writing is performed and a video signal writing period in which video signal writing is initially performed after the non-video signal writing and transition the potential of the source line X to a level which is close to an intermediate gradation display level corresponding to a video signal in the precharge period.

9 Claims, 13 Drawing Sheets

LIQUID CRYSTAL DISPLAY DEVICE

CROSS-REFERENCE TO RELATED APPLICATIONS

This application is based upon and claims the benefit of priority from prior Japanese Patent Application No. 2006-185812, filed Jul. 5, 2006, the entire contents of which are incorporated herein by reference.

BACKGROUND OF THE INVENTION

1. Field of the Invention

This invention relates to a liquid crystal display device having a display panel used to perform video signal display corresponding to a video signal for each frame period, for example, and perform non-video signal display which does not correspond to the video signal.

2. Description of the Related Art

A flat-panel display device represented by a liquid crystal display device is widely used to display images in a computer, car navigation system, television receiver or the like. Generally, the liquid crystal display device includes a liquid crystal display panel having a matrix array of liquid crystal pixels, a backlight which illuminates the liquid crystal display panel and a display control circuit which controls the liquid crystal display panel and backlight.

The liquid crystal display panel has a structure in which a liquid crystal layer is held between an array substrate and a counter-substrate. Generally, the array substrate has a plurality of pixel electrodes substantially arranged in a matrix form, a plurality of gate lines arranged along the rows of pixel electrodes, a plurality of source lines arranged along the columns of pixel electrodes, and thin film transistors (TFT) arranged as pixel switching elements near the intersections between the gate lines and the source lines. Each thin film transistor is made conductive to apply the potential of a corresponding source line to a corresponding pixel electrode when a corresponding gate line is driven. The counter-substrate has a color filter and a common electrode arranged to cover the color filter and face the pixel electrodes. A pair of the pixel electrode and common electrode is associated with a pixel area which is part of the liquid crystal layer located between the electrodes to configure a liquid crystal pixel. A potential difference between the pixel electrode and the common electrode is held as a liquid crystal drive voltage after the thin film transistor is made nonconductive and controls the liquid crystal molecular orientation in the pixel area by use of an electric field corresponding to the liquid crystal drive voltage. In the above control operation, when the liquid crystal molecular orientation is controlled by use of the one-directional electric field, the liquid crystal molecules are unevenly distributed in the liquid crystal layer and finally set into an uncontrollable state. When the potential of the common electrode is constant, for example, the potential of the pixel electrode is set to periodically invert the polarity of the liquid crystal drive voltage between the common electrode and the pixel electrode for every preset number of horizontal periods (H) in addition to one frame period (V=vertical period) in order to prevent occurrence of the uneven distribution.

The display control circuit includes a gate driver which drives the gate lines, a source driver which drives the source lines by the pixel voltages for the pixel electrodes of the pixels (horizontal pixel line) of a row corresponding to the gate line driven by the gate driver and a controller circuit which controls the operation timings of the gate driver and source driver.

In the field of large-scale liquid crystal television receivers, a liquid crystal display panel of an OCB (Optically Compensated Bend) mode having the high-speed liquid crystal response characteristic required for moving image display is adopted. The liquid crystal display panel performs the display operation in an alignment state of the liquid crystal molecules previously transitioned from the splay alignment to the bend alignment. The bend alignment is reversely transitioned to the splay alignment when a voltage-non-applied state or a state close to the voltage-non-applied state is maintained for a long period of time. In the above liquid crystal display panel, black insertion driving is used with the intention of preventing reverse transition to the splay alignment (refer to Jpn. Pat. Appln. KOKAI Publication No. 2002-202491). In this case, the liquid crystal display panel is driven to perform the video signal display in a period corresponding to approximately 80%, for example, of one frame period and perform the black display (non-video signal display) in which the liquid crystal drive voltage becomes the maximum in the remaining period corresponding to approximately 20% of one frame period. Further, the black insertion driving The black insertion driving provides discrete pseudo-impulse response of luminance similar to a CRT in a moving image display. This is effective to clear the retinal persistence occurring on viewer's vision and display the movement of an object smoothly.

FIG. 13 shows an example of black insertion driving of a 4H1V inversion type in which the polarity of the liquid crystal drive voltage is inverted in units of four horizontal periods and in units of one frame period. In the black insertion driving, the gate lines Y1, Y2, Y3, Y4, . . . should be scanned twice in total for each frame period to perform black insertion writing and video signal writing. The gate lines Y1, Y2, Y3, Y4, . . . are divided into groups of four lines, sequentially driven at the rate of one group for every 4H for black insertion writing and driven at the rate of one group for every 4H for video signal writing with a delay of the black insertion period (approximately 20% of one frame period) from the start of the black insertion writing. At this time, in order to prevent collision between the black insertion writing and video signal writing, each group is driven during the first one of 4H/5 periods obtained by equally dividing 4H assigned to the group for black insertion writing by five and driven during the second, third, fourth and fifth ones of 4H/5 periods obtained by equally dividing 4H assigned to the group for video signal writing by five. As shown in FIG. 13, the gate driver outputs four gate pulses in parallel to drive the gate lines Y1 to Y4, Y5 to Y8, . . . of each group for black insertion writing and sequentially outputs four gate pulses to drive the gate lines Y1 to Y4, Y5 to Y8, . . . of each group for video signal writing. The source driver converts black signals (non-video signals) for a corresponding horizontal pixel line into pixel voltages and outputs the thus converted pixel voltages to the source lines X1 . . . in parallel when the gate lines Y1 to Y4, Y5 to Y8, . . . of each group are driven for black insertion writing. Further, it converts video signals for a corresponding horizontal pixel line into pixel voltages and outputs the thus converted pixel voltages to all of the source lines X1 . . . in parallel when each of the gate lines Y1 to Y4, Y5 to Y8, . . . is driven for video signal writing. Thus, every 4-row liquid crystal pixels (four horizontal pixel lines) are simultaneously subjected to the black insertion writing performed in the first 4H/5 period which is contained in the four horizontal periods assigned thereto, and subjected to the video signal writing performed in the second, third, fourth and fifth 4H/5 periods which are contained in the four horizontal periods assigned thereto. The pixel voltage polarity is inverted in units of four horizontal pixel lines and in units of all the horizontal pixel lines. Further, it is preferable that the pixel voltage polarity is inverted for each pixel in each horizontal pixel line. In the above black insertion driving, the writing operation is performed five times for every four horizontal periods. Thus, the black insertion driving is referred to as a 1.25×-speed driving operation in contrast to a driving operation in which the video signal writing is performed one time for each horizontal period without performing the black insertion writing.

As another example of the black insertion driving, a 1.5× speed driving operation in which the writing operation is performed three times (one black insertion writing operation and two video signal writing operations) for every two horizontal periods and a double speed driving operation in which the writing operation is performed two times (one black insertion writing operation and one video signal writing operation) for each horizontal period are considered, for example. Generally, when n is a natural number, an (n+1)/n X-speed driving operation in which the writing operation is performed (n+1) times (one black insertion writing operation and n video signal writing operations) for every n horizontal periods is considered. If n is increased, the ratio of the total black insertion writing period to the total video signal writing period can be reduced. However, the increase of n increases a difference between the black insertion periods for the horizontal pixel lines corresponding to the gate lines of each group. If n is set to 4 as shown in the example of the black insertion driving shown in FIG. 13, a difference of three horizontal periods occurs between the black insertion periods for the horizontal pixel lines corresponding to the gate lines Y1 and Y4, for example. According to our experiments, it was confirmed that the quality of a display image on the display panel was not deteriorated due to a difference between the black insertion periods at the time of n=4. On the other hand, the result that a difference between the black insertion periods was recognized as a black stripe due to a difference in the luminance on the display panel was obtained at the time of n≧5. Therefore, it is preferable to set n to 4 or less, that is, n=1, 2, 3 or 4.

When the 4H1V inversion type black insertion driving is applied to the large-scale liquid crystal display panel, for example, the following problem occurs when a video signal for intermediate gradation display is written into all the pixels. In the large-scale liquid crystal display panel, since the time constant of the source line which acts as a load of the source driver, that is, the load capacitance is large, the video signal writing period for one horizontal pixel line is terminated in some cases before potentials of the entire source lines are transitioned to the intermediate gradation display level by the first video signal writing following after the black insertion writing. In other words, the video signal writing period becomes insufficient for the length required for transition of the source line potential. Specifically, the video signal writings for four horizontal pixel lines are sequentially performed after the black insertion writing, but in this case, the luminance of the first horizontal pixel line becomes lower than the luminance of the remaining three horizontal pixel lines and this is recognized as a lateral stripe. The lateral stripe occurs in units of four horizontal pixel lines in the liquid crystal display panel. In general, when the video signal writings for n horizontal pixel lines are sequentially performed after the black insertion writing, the lateral stripe occurs in units of n horizontal pixel lines (refer to Jpn. Pat. Appln. KOKAI Publication No. 2003-280036).

Further, a multiplexer is provided on the liquid crystal display panel in some cases in order to reduce the circuit scale of the source driver. For example, when the number of output terminals of the source driver is reduced to half the number of source lines, the multiplexer connects all of the output terminals of the source driver to half of the source lines in the first half of the video signal writing period for each horizontal pixel line and connects all of the output terminals of the source driver to the remaining half of the source lines in the latter half of the video signal writing period. That is, each horizontal pixel line is driven in two separate cycles. If the black insertion driving is performed in addition to the division driving, the video signal writing period is reduced to half in comparison with a case wherein the division driving is not performed and a pixel voltage writing error due to insufficiency of the video signal writing period becomes significant. Therefore, occurrence of the lateral stripe becomes serious due to utilization of the multiplexer.

Conventionally, when the video signal writing is performed after the non-video signal writing, there occurs a problem that the lateral stripe is generated.

BRIEF SUMMARY OF THE INVENTION

An object of this invention is to provide a liquid crystal display device capable of suppressing a lateral stripe occurring when the video signal writing is performed after the non-video signal writing.

According to a first aspect of the present invention, there is provided a liquid crystal display device comprising a liquid crystal display panel in which a plurality of liquid crystal pixels are connected to a source line via pixel switching elements, and a display control circuit which performs non-video signal writing for driving the source line according to a non-video signal and applying the potential of the source line to one of the liquid crystal pixels via a selected one of the pixel switching elements and performs video signal writing for driving the source line according to a video signal after the non-video signal writing and applying the potential of the source line to one of the liquid crystal pixels via a selected one of the pixel switching elements, wherein the display control circuit is configured to provide a precharge period between a non-video signal writing period in which the non-video signal writing is performed and a video signal writing period in which the video signal writing is initially performed after the non-video signal writing period and transition the potential of the source line to a level which is close to an intermediate gradation display level corresponding to the video signal in the precharge period.

According to a second aspect of the present invention, there is provided a liquid crystal display device comprising a liquid crystal display panel having a plurality of liquid crystal pixels arranged in a matrix form, a plurality of gate lines arranged along the rows of liquid crystal pixels, a plurality of source lines arranged along the columns of liquid crystal pixels and a plurality of pixel switching elements which are arranged near intersections between the gate lines and the source lines and each of which applies the potential of a corresponding one of the source lines as a pixel voltage to a corresponding one of the liquid crystal pixels when driven via a corresponding one of the gate lines, and a display control circuit which performs non-video signal writing for driving the source lines according to a non-video signal while the gate lines are being driven in parallel for every preset number and performs video signal writing for driving the source lines according to a video signal while the gate lines are being sequentially driven for every preset number, wherein the display control circuit is configured to provide a precharge period between a non-video signal writing period in which a preset number of gate lines are driven for the non-video signal writing and a video signal writing period in which one of the preset number of gate lines is initially driven for the video signal writing after the non-video signal writing period and transition the potentials of the source lines to a level which is close to an intermediate gradation display level corresponding to the video signal in the precharge period.

In the above liquid crystal display devices, the display control circuit is configured to provide a precharge period between a non-video signal writing period and an initial video signal writing period following after the non-video signal writing period and transition the potential of the source line to a level which is close to a level corresponding to a video signal in the precharge period. When, for example, the potential of the source line is set to a black-display level according to the non-video signal in the non-video signal writing period, the potential of the source line is transitioned from the black-display level to an intermediate gradation display level in the precharge period following after the non-video signal writing period. Even when the precharge period becomes insufficient with respect to a period required for transition from the black-display level to the intermediate gradation display level, the potential of the source line can reach the intermediate gradation display level without fail in the initial video signal writing period following after the precharge period and occurrence of a pixel voltage writing error for the liquid crystal pixel can be prevented. Therefore, occurrence of lateral stripes can be suppressed when the video signal writing is performed after the non-video signal writing.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

There will now be described a liquid crystal display device according to a first embodiment of this invention with reference to the accompanying drawings.

Figure 1:
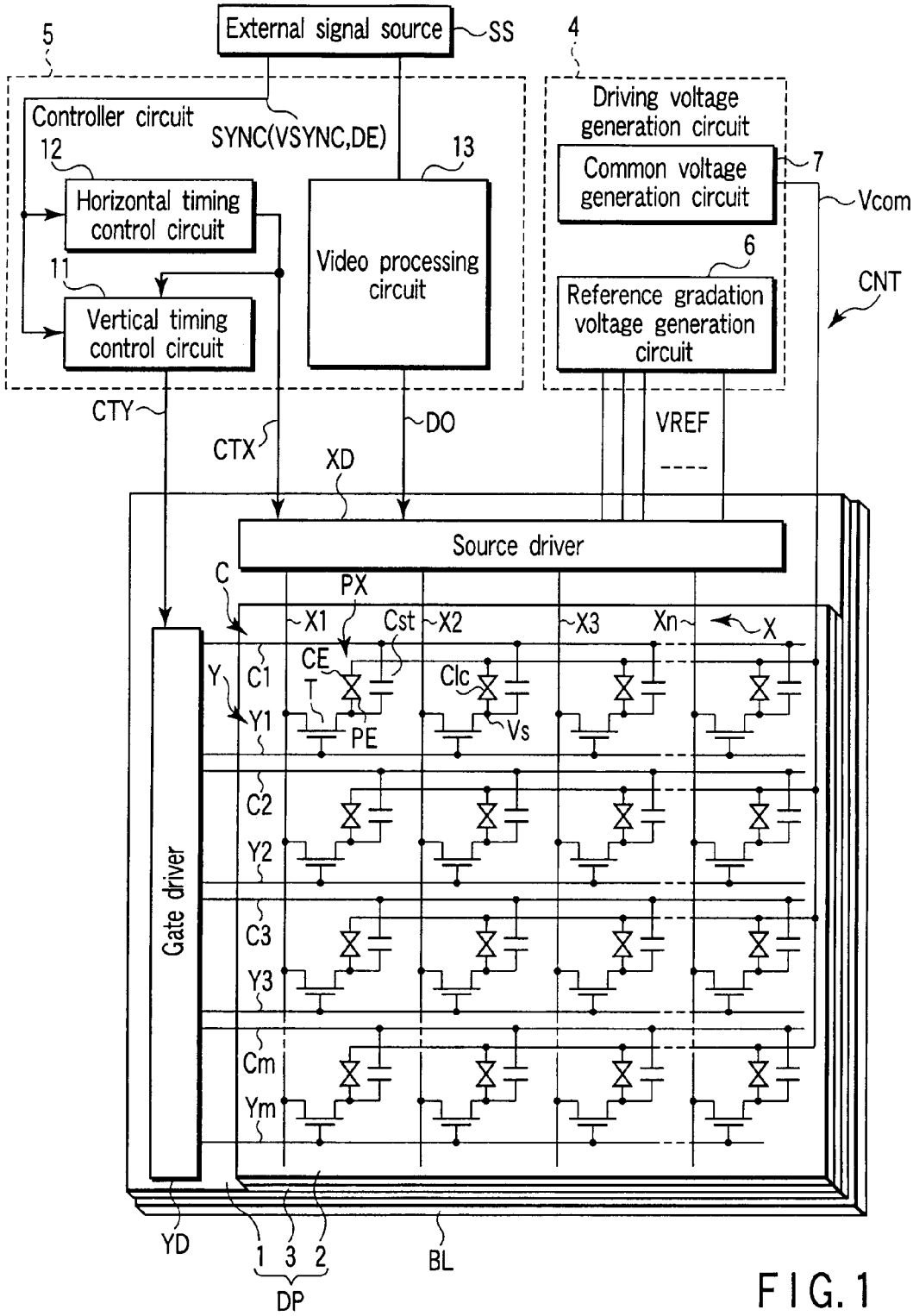
FIG. 1 is a diagram schematically showing the circuit configuration of a liquid crystal display device according to a first embodiment of this invention.

FIG. 1 schematically shows the circuit configuration of the liquid crystal display device. The liquid crystal display device includes a liquid crystal display panel DP, a backlight BL which illuminates the display panel DP and a display control circuit CNT which controls the display panel DP and backlight BL. The liquid crystal display panel DP has a structure in which a liquid crystal layer 3 is held between an array substrate 1 and counter-substrate 2 which are paired electrode substrates. For example, the liquid crystal layer 3 contains an OCB liquid crystal material in which the alignment of liquid crystal molecules are transitioned in advance from the splay alignment to the bend alignment for normally white display and reverse transition from the bend alignment to the splay alignment is prevented by periodical application of a voltage for black display. The display control circuit CNT controls the transmittance of the liquid crystal display panel DP by use of liquid crystal driving voltage applied to the liquid crystal layer 3 from the array substrate 1 and counter-substrate 2. Transition from the splay alignment to the bend alignment is attained by applying a relatively intense electric field to the liquid crystal in a predetermined initialization process performed by the display control circuit CNT at the time of power supply.

Figure 2:
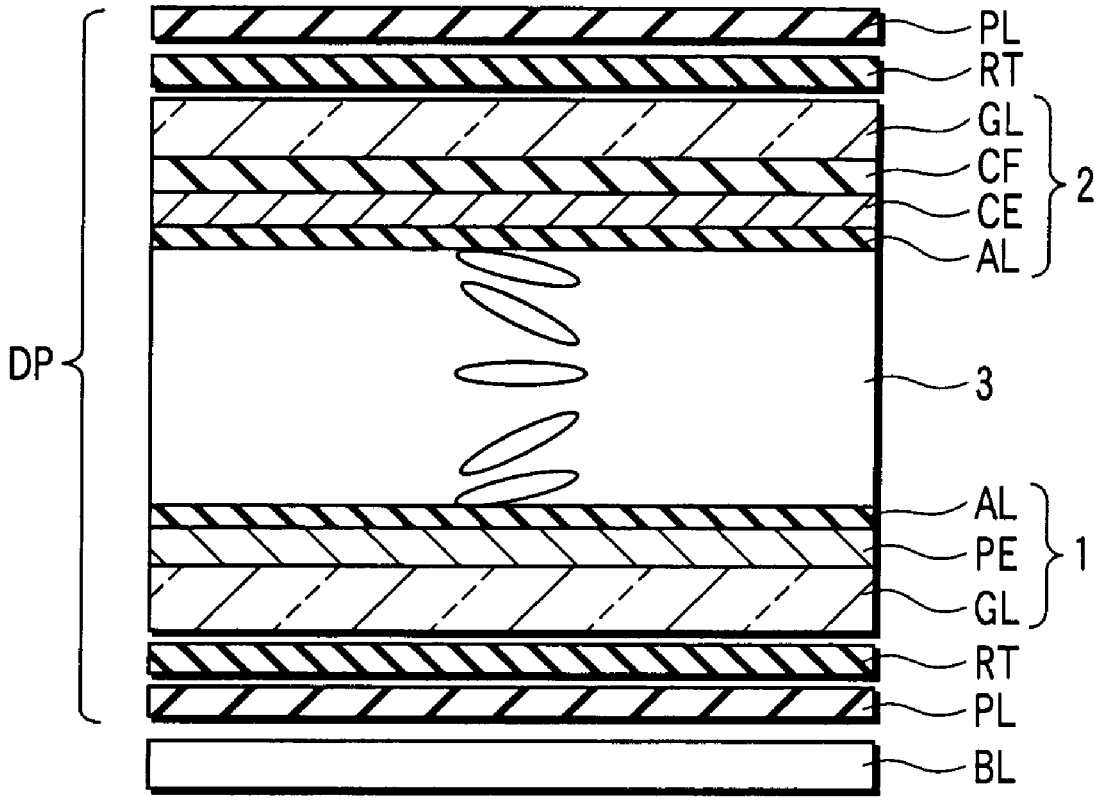
FIG. 2 is a view schematically showing the cross sectional structure of a liquid crystal display panel shown in FIG. 1.

The liquid crystal display panel DP has the cross sectional structure as shown in FIG. 2. The array substrate 1 includes a transparent insulating substrate GL formed of a glass plate or the like, a plurality of pixel electrodes PE formed on the transparent insulating substrate GL and an alignment film AL formed on the pixel electrodes PE. The counter-electrode 2 includes a transparent insulating substrate GL formed of a glass plate or the like, a color filter CF formed on the transparent insulating substrate GL, a common electrode CE formed on the color filter CF and an alignment film AL formed on the common electrode CE. The liquid crystal layer 3 can be obtained by filling the OCB liquid crystal material into a gap between the array substrate 1 and the counter-substrate 2. In FIG. 2, liquid crystal molecules are set in the splay alignment. Further, the liquid crystal display panel DP includes a pair of retardation films RT respectively formed on the outer surfaces of the array substrate 1 and counter-substrate 2 and a pair of polarizers PL respectively arranged on the outer surfaces of the above retardation films. The backlight BL is an illumination light source arranged on the outer surface of the polarizer on the array substrate 1 side. The alignment film AL on the array substrate 1 side and the alignment film AL on the counter-substrate 2 side are subjected to the rubbing treatment in parallel directions. Thus, the pre-tilt angle of the liquid crystal molecules is set to approximately 10°.

A plurality of pixel electrodes PE are arranged in substantially a matrix form on the transparent insulating film GL in the array substrate 1. Further, a plurality of gate lines Y (Y1 to Ym) are arranged along the rows of pixel electrodes PE and a plurality of source lines X (X1 to Xn) are arranged along the columns of pixel electrodes PE. As pixel switching elements, thin film transistors T are arranged near the intersections between the gate lines Y and the source lines X. Each of the thin film transistors has a gate connected to a corresponding one of the gate lines Y and a source-drain path connected between a corresponding one of the source lines X and a corresponding one of the pixel electrodes PE and is made conductive to apply the potential of the source line X to the pixel electrode PE when driven via the gate lines Y.

For example, each pixel electrode PE and common electrode CE are formed of a transparent electrode material such as ITO and respectively covered with the alignment films AL, and associated with a pixel region which is part of the liquid crystal layer 3 to configure a liquid crystal pixel PX. The liquid crystal molecular orientation in the pixel region is controlled by an electric field corresponding to the liquid crystal driving voltage which is a potential difference between the pixel electrode PE and the common electrode CE. The color filter layer CF includes stripe-form red-colored layers, green-colored layers and blue-layered layers repeatedly arranged in the row direction in opposition to the columns of the pixel electrodes PE. In this case, the red-colored layers face the pixel electrodes PE on the first, fourth, seventh, . . . columns to set the liquid crystal pixels PX corresponding to the above pixel electrodes PE into red pixels. The green-colored layers face the pixel electrodes PE on the second, fifth, eighth, . . . columns to set the liquid crystal pixels PX corresponding to the above pixel electrodes PE into green pixels. The blue-colored layers face the pixel electrodes PE on the third, sixth, ninth, . . . columns to set the liquid crystal pixels PX corresponding to the above pixel electrodes PE into blue pixels.

The liquid crystal pixels PX have liquid crystal capacitances C1*c* between the respective pixel electrodes PE and the common electrode CE. A plurality of storage capacitance lines C1 to Cm are capacitively coupled with the pixel electrodes PE of the liquid crystal pixels PX of corresponding rows to configure storage capacitances Cst.

The display control circuit CNT includes a gate driver YD which selectively drives a plurality of gate lines Y1 to Ym, a source driver XD which drives a plurality of source lines X1 to Xn in parallel, a driving voltage generation circuit 4 which generates voltages for driving the display panel DP and a controller circuit 5 which controls the gate driver YD and source driver XD. The gate driver YD is also used to set the storage capacitance lines C1 to Cm to a preset potential.

The driving voltage generation circuit 4 includes a reference gradation voltage generation circuit 6 which generates a preset number of reference gradation voltages VREF which are used by the source driver XD and a common voltage generation circuit 7 which generates a common voltage Vcom applied to the common electrode CE. The controller circuit 5 includes a vertical timing control circuit 11 which generates a control signal CTY for the gate driver YD based on a sync signal SYNC input from an external signal source SS, a horizontal timing control circuit 12 which generates a control signal CTX for the source driver XD based on the sync signal SYNC input from the external signal source SS and a video processing circuit 13 which performs a conversion operation for black insertion driving. In the conversion operation, a black signal (non-video signal) or precharge signal is added to a video signal input from the signal source SS. The video signal, black signal and precharge signal contain items of pixel data for the liquid crystal pixels PX of each row (horizontal pixel line) and are updated for each frame period (V=vertical period). The control signal CTY is supplied to the gate driver YD and the control signal CTX is supplied to the source driver XD together with pixel data DO obtained as the conversion result from the video processing circuit 13. The control signal CTY is used for vertical timing control of the gate driver YD required for driving the gate lines Y1 to Ym and the control signal CTX is used for horizontal timing control of the source driver XD required for driving the source lines.

In the black insertion driving, black insertion writing and video signal writing are performed in units a preset number of horizontal pixel lines in each frame period. Therefore, the gate driver YD is controlled by the control signal CTY to drive the gate lines Y1 to Ym for every preset number in parallel for black insertion writing (non-video signal writing) and sequentially drive the gate lines Y1 to Ym for every preset number for video signal writing. Further, the source driver XD is controlled by the control signal CTX to convert pixel data items DO for the liquid crystal pixels PX of each row serially output as the conversion result from the video processing circuit 13 into pixel voltages by use of the reference gradation voltages VREF, drive the source lines X1 to Xn in parallel by use of the pixel voltages and periodically invert the polarities of the pixel voltages. The pixel voltages are voltages Vs applied to the pixel electrodes PE with the common voltage Vcom of the common electrode CE used as a reference.

Figure 3:
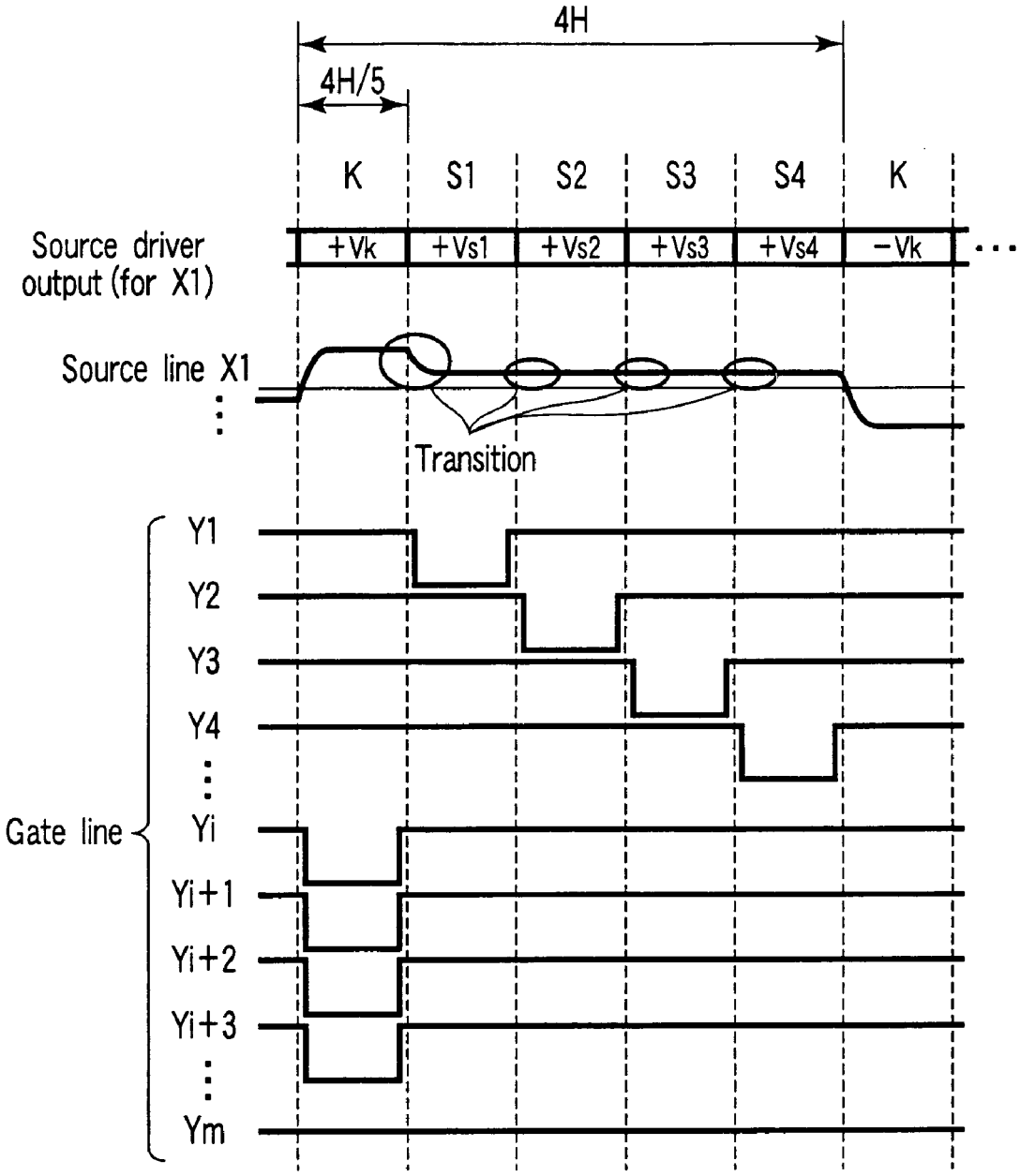
FIG. 3 is a time chart showing a standard 4H1V inversion type black insertion driving applied to the liquid crystal display panel shown in FIG. 1 as a comparison example.

FIG. 3 shows a standard 4H1V inversion type black insertion driving performed for the liquid crystal display panel DP as a comparison example. In the black insertion driving, the black insertion writing and video signal writing are performed for the four horizontal pixel lines for every four horizontal periods and the polarities in the black insertion writing and video signal writing are inverted for every four horizontal periods (4H) and for each frame period (1V). Generally, as shown in FIG. 3, the four horizontal periods are equally divided into five portions, the first 4H/5 period is assigned to a black insertion writing period K and the second, third, fourth and fifth 4H/5 periods are respectively assigned to video signal writing periods S1, S2, S3, S4.

Figure 13:
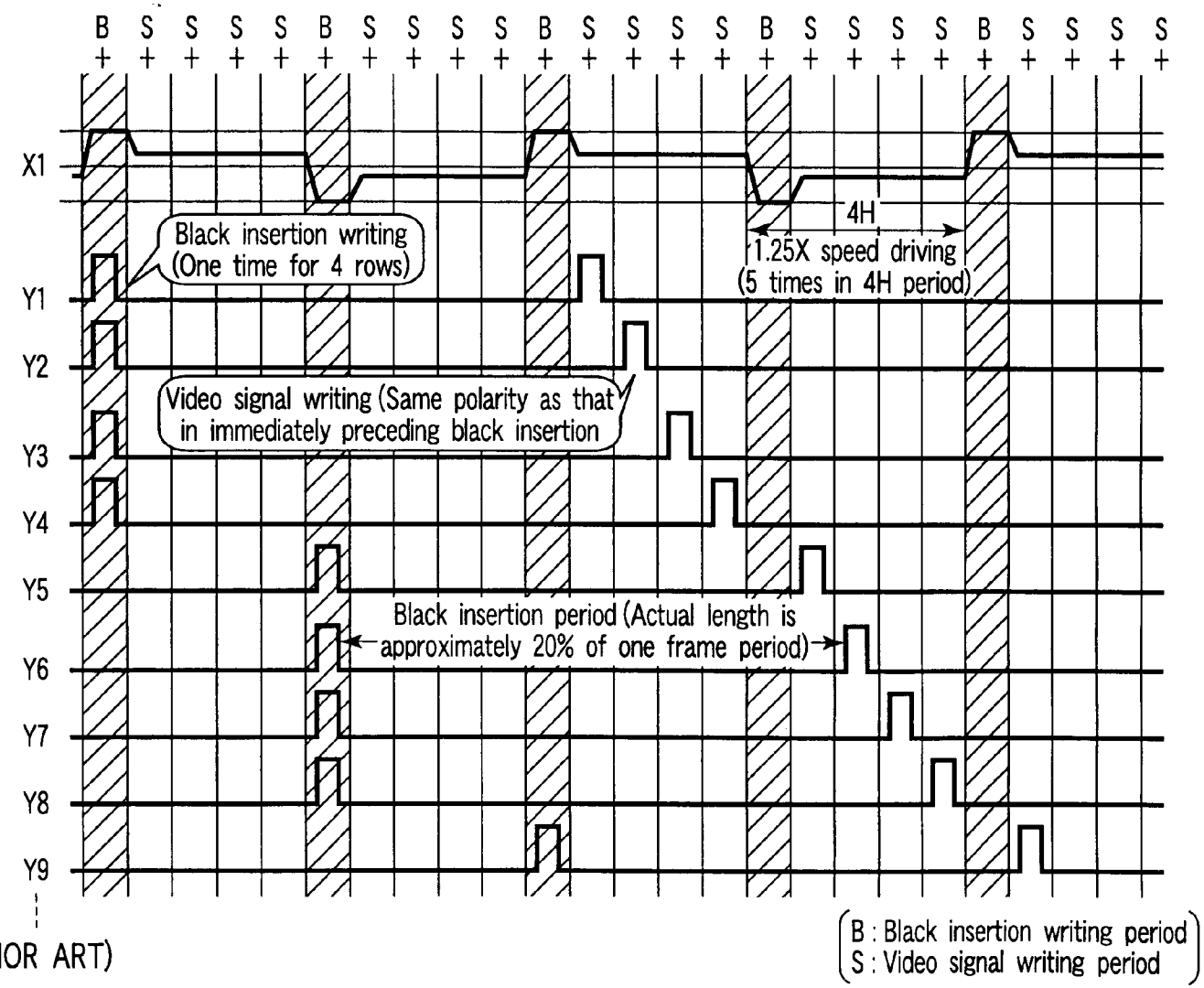
FIG. 13 (PRIOR ART)
FIG. 13 shows an example of a standard 4H1V inversion type black insertion driving.

In the black insertion writing period K, black signals are supplied to the source driver XD as pixel data items DO for the four horizontal pixel lines, respectively. The source driver XD converts the pixel data items DO into black display pixel voltages +Vk, −Vk, +Vk, −Vk, . . . which are set to have the inverted polarities for the respective pixel columns by use of the reference gradation voltages VREF and respectively outputs the black display pixel voltages to the source lines X1 to Xn. On the other hand, the gate driver YD outputs four gate pulses to the four gate lines Yi to Yi+3 during this period of time to turn on all of the pixel switching elements T connected to the gate lines Yi to Yi+3. Further, the black display pixel voltages +Vk, −Vk, +Vk, −Vk, . . . are applied to the pixels PX of each of the four horizontal pixel lines from the source lines X1 to Xn via the switching elements T during this period of time. In the present embodiment, each of the gate lines Y1 to Ym is driven upon a fall of the gate pulse in opposition to a case of FIG. 13.

In the video signal writing period S1, a video signal is supplied to the source driver XD as pixel data items DO for the first horizontal pixel line among the four horizontal pixel lines different from that used in the black insertion writing. The source driver XD converts the pixel data items DO into video display pixel voltages +Vs1, −Vs1, +Vs1, −Vs1, . . . which are set to have the inverted polarities for each pixel column by use of the reference gradation voltages VREF and respectively outputs the video display pixel voltages to the source lines X1 to Xn. On the other hand, the gate driver YD outputs a single gate pulse to the gate line Y1, for example, during this period of time to turn on all of the pixel switching elements T connected to the gate line Y1. The video display pixel voltages +Vs1, −Vs1, +Vs1, −Vs1, . . . are applied to the pixels PX of the first horizontal pixel line from the source lines X1 to Xn via the switching elements T during this period of time.

In the video signal writing period S2, a video signal is supplied to the source driver XD as pixel data items DO for the second horizontal pixel line. The source driver XD converts the pixel data items DO into video display pixel voltages +Vs2, −Vs2, +Vs2, −Vs2, . . . which are set to have the inverted polarities for each pixel column by use of the reference gradation voltages VREF and respectively outputs the video display pixel voltages to the source lines X1 to Xn. On the other hand, the gate driver YD outputs a single gate pulse to the gate line Y2 during this period of time to turn on all of the pixel switching elements T connected to the gate line Y2. The video display pixel voltages +Vs2, −Vs2, +Vs2, −Vs2, . . . are applied to the pixels PX of the second horizontal pixel line from the source lines X1 to Xn via the switching elements T during this period of time.

In the video signal writing period S3, a video signal is supplied to the source driver XD as pixel data items DO for the third horizontal pixel line. The source driver XD converts the pixel data items DO into video display pixel voltages +Vs3, −Vs3, +Vs3, −Vs3, . . . which are set to have the inverted polarities for each pixel column by use of the reference gradation voltages VREF and respectively outputs the video display pixel voltages to the source lines X1 to Xn. On the other hand, the gate driver YD outputs a single gate pulse to the gate line Y3 during this period of time to turn on all of the pixel switching elements T connected to the gate line Y3. The video display pixel voltages +Vs3, −Vs3, +Vs3, −Vs3, . . . are applied to the pixels PX of the third horizontal pixel line from the source lines X1 to Xn via the switching elements T during this period of time.

In the video signal writing period S4, a video signal is supplied to the source driver XD as pixel data items DO for the fourth horizontal pixel line. The source driver XD converts the pixel data items DO into video display pixel voltages +Vs4, −Vs4, +Vs4, −Vs4, . . . which are set to have the inverted polarities for each pixel column by use of the reference gradation voltages VREF and respectively outputs the video display pixel voltages to the source lines X1 to Xn. On the other hand, the gate driver YD outputs a single gate pulse to the gate line Y4 during this period of time to turn on all of the pixel switching elements T connected to the gate line Y4. The video display pixel voltages +Vs4, −Vs4, +Vs4, −Vs4, . . . are applied to the pixels PX of the fourth horizontal pixel line from the source lines X1 to Xn via the switching elements T during this period of time.

The above operations are repeatedly performed while the pixel voltage polarity is inverted in units of four horizontal periods. Further, the pixel voltage polarity is inverted in units of one frame period. In this case, the black insertion period from the black insertion writing of the first horizontal pixel line to the video signal writing of the first horizontal pixel line is set to approximately 20% of one frame period.

Now, attention is paid to the potential of the source line X1 in the black insertion driving shown in FIG. 3. Then, after the potential of the source line X1 is set to the pixel voltage +Vk in the black insertion writing period K, the potential is mainly transitioned in portions near circular marks shown in FIG. 3. That is, the potential of the source line X1 is transitioned from a level equal to the pixel voltage +Vk to a level equal to the pixel voltage +Vs1 in the first video signal writing period S1, transitioned from a level equal to the pixel voltage +Vs1 to a level equal to the pixel voltage +Vs2 in the second video signal writing period S2, transitioned from a level equal to the pixel voltage +Vs2 to a level equal to the pixel voltage +Vs3 in the third video signal writing period S3 and transitioned from a level equal to the pixel voltage +Vs3 to a level equal to the pixel voltage +Vs4 in the fourth video signal writing period S4. The pixel voltage +Vk is the maximum voltage used for black display and the pixel voltage +Vs1 is set at a level lower than the maximum level and mainly used for display of a video signal which is set at an intermediate gradation level. Therefore, the potential difference between +Vk and +Vs1 is set larger than the potential differences between +Vs1 and +Vs2, between +Vs2 and +Vs3 and between +Vs3 and +Vs4 and the transition time in the video signal writing period S1 becomes longer than the transition times in the video signal writing periods S2, S3, S4. Thus, when the time constant of the source line X1 used as the load of the source driver XD is large, the video signal writing period S1 is terminated during the potential transition of the source line X1 and a pixel voltage writing error will occur.

Figure 4:
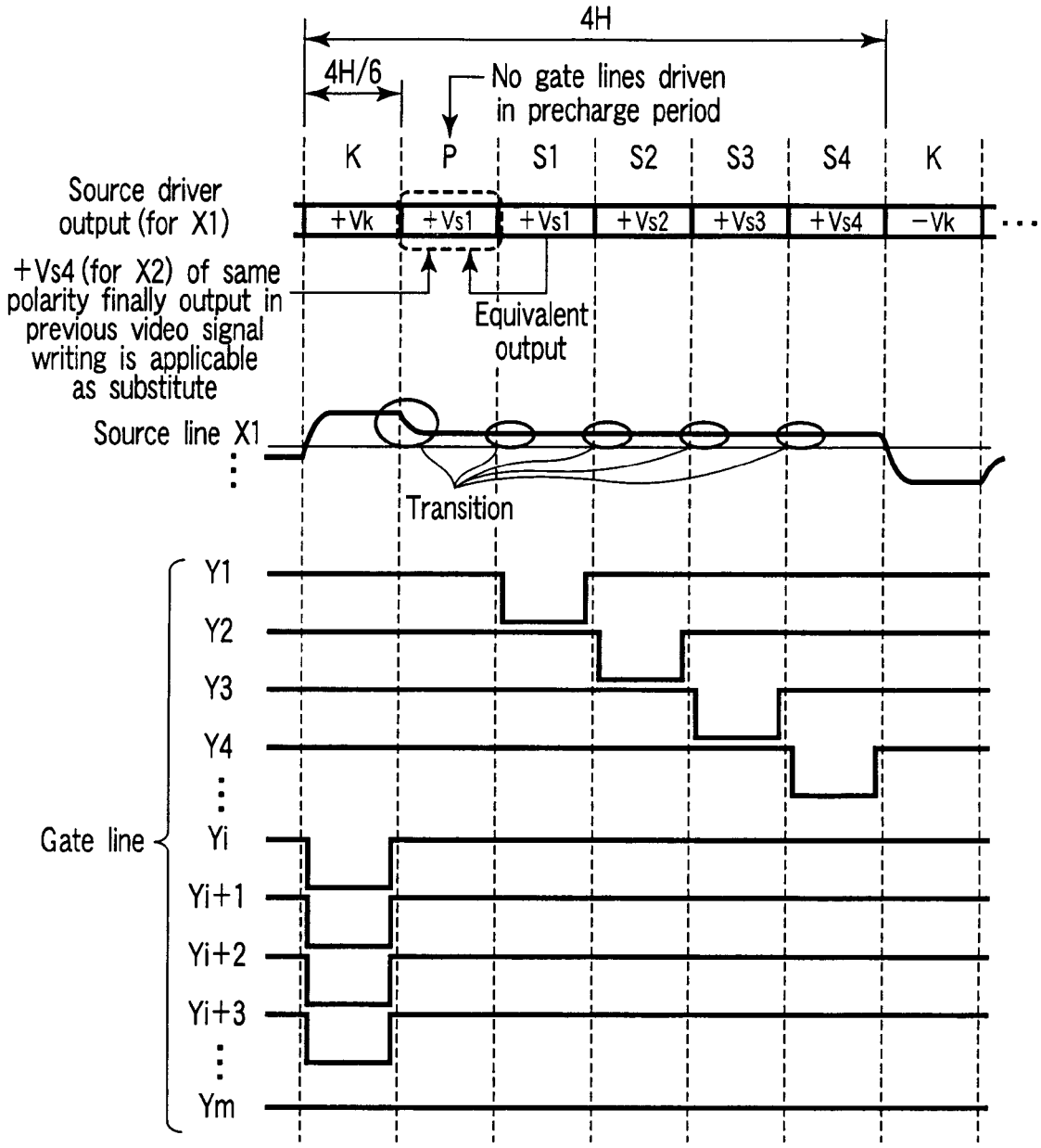
FIG. 4 is a time chart showing a 4H1V inversion type black insertion driving performed by a display control circuit CNT shown in FIG. 1.

The display control circuit CNT shown in FIG. 1 performs a 4H1V inversion type black insertion driving shown in FIG. 4 in order to prevent occurrence of the above writing error. Like the black insertion driving shown in FIG. 3, in the above black insertion driving, the black insertion writing and video signal writing operation are performed for four horizontal pixel lines for every four horizontal periods and the polarities in the black insertion writing and video signal writing are inverted for every four horizontal periods (4H) and for each frame period (1V). In this case, as shown in FIG. 4, the four horizontal periods are equally divided into six portions, the first 4H/6 period is assigned to the black insertion writing period K, the second 4H/6 period is assigned to the precharge period P, and the third, fourth, fifth and sixth 4H/6 periods are assigned to the video signal writing periods S1, S2, S3, S4. That is, the display control circuit CNT is configured to provide the precharge period P between the black insertion writing period K in which the four gate lines Yi to Yi+3 are driven for black insertion writing and the video signal writing period S1 in which one of the four gate lines Y1 to Y4 is initially driven for video signal writing after the black insertion writing period K and transition the potentials of the source lines X1 to Xn to intermediate gradation display levels corresponding to a video signal in the precharge period P.

Like the case of the 4H1V inversion type black insertion driving operation shown in FIG. 3, the source driver XD and gate driver YD are operated in the black insertion writing period K and video signal writing periods S1, S2, S3, S4. On the other hand, in the precharge period P, the precharge signal is supplied to the source driver XD as pixel data items DO respectively assigned to the source lines X1 to Xn. For example, the source driver XD converts the pixel data items DO into video display pixel voltages +Vs1, −Vs1, +Vs1, −Vs1, . . . which are set to have the inverted polarities for each pixel column by use of the reference gradation voltages VREF and outputs the video display pixel voltages to the respective source lines X1 to Xn. Further, the gate driver YD does not output a gate pulse to any one of the gate lines Y1 to Ym during this period of time, for example, and maintains all of the pixel switching elements T connected to the gate lines Y1 to Ym in the OFF state. The precharge signal is used to previously transition the potentials of the source lines X1 to Xn towards an intermediate gradation display level closer to a video display level rather than a black display level in the precharge period. In this example, the video display pixel voltages +Vs1, −Vs1, +Vs1, −Vs1, . . . are output to the source lines X1 to Xn in the precharge period P as an example in which the intermediate gradation display level equivalent to a level at which the pixel voltages are set in the video signal writing period S1 is obtained.

The potential of the source line X1 is transitioned from a level equal to the pixel voltage +Vk towards a level equal to the pixel voltage +Vs1 in the precharge period P. Even when the precharge period P is terminated in the course of the transition, the potential of the source line X1 is further transitioned towards the level equal to the pixel voltage +Vs1 in the video signal writing period S1. The length of the video signal writing period S1 shown in FIG. 4 is set to the length of 4H/6 which is shorter than 4H/5 assigned to the video signal writing period S1 shown in FIG. 3. However, the length of 4H/6 which is assigned to the precharge period P is added to the length of the video signal writing period S1 and it is only required for the potential of the source line X1 to transition from the level equal to the pixel voltage +Vk to the level equal to the pixel voltage +Vs1 in the total period of 8H/6. Thus, it becomes possible to transition the potential of the source line X1 to the level equal to the pixel voltage +Vs1 until the end of the video signal writing period S1 and prevent occurrence of an error in the writing operation of the pixel voltage +Vs1 performed by use of the source line X1. This can be applied to the remaining source lines X2 to Xn.

The source driver XP may output pixel voltages other than the pixel voltages +Vs1, −Vs1, +Vs1, −Vs1, . . . to the source lines X1 to Xn in the precharge period P and transition the potentials of the source lines X1 to Xn to desired intermediate gradation display levels which are closer to the video display level rather than the black display level. Generally, a frame memory is required in order to serve the above purpose, but the frame memory can be made unnecessary by outputting the pixel voltages +Vs1, −Vs1, +Vs1, −Vs1, . . . in the precharge period P as described above or performing the operation explained as follows.

Although not shown in FIG. 4, for example, the video display pixel voltages −Vs4, +Vs4, −Vs4, +Vs4, . . . set to have inverted polarities are output from the source driver XP to the source lines X1 to Xn in the final video signal writing period S4 preceding the black insertion writing period K in which the black display pixel voltages +Vk, −Vk, +Vk, −Vk, . . . are output from the source driver XD. For example, when all of the pixels PX perform the same intermediate gradation display operation according to the video signal, the pixel voltages −Vs4, +Vs4, −Vs4, +Vs4, . . . are the same as the pixel voltages +Vs1, −Vs1, +Vs1, −Vs1, . . . output to the source lines X1 to Xn in the video signal writing period S1 except that the polarities thereof are inverted. Therefore, if the polarities are set to the same polarities, the pixel voltages can be substituted as the pixel voltages +Vs1, −Vs1, +Vs1, −Vs1, . . . output in the precharge period P. Specifically, the arrangement of the pixel data items DO of the precharge signal may be transitioned, the pixel voltages −Vs4, −Vs4, −Vs4, . . . output to the odd-numbered source lines X1, X3, X5, . . . in the final video signal writing period S4 preceding the black insertion writing period K may be output to the even-numbered source lines X2, X4, X6, . . . in the precharge period P and the pixel voltages +Vs4, +Vs4, +Vs4, . . . output to the even-numbered source lines X2, X4, X6, . . . in the final video signal writing period S4 preceding the black insertion writing period K may be output to the odd-numbered source lines X1, X3, X5, . . . in the precharge period P.

As described above, in the first embodiment, the precharge period P is provided between the black insertion writing period K in which the four gate lines Yi to Yi+3 are driven for black insertion writing and the video signal writing period S1 in which one of the four gate lines Y1 to Y4 is initially driven for video signal writing after the black insertion writing period K and the potentials of the source lines X1 to Xn are set to intermediate gradation display levels in the precharge period P. When, for example, the potentials of the source lines X1 to Xn are set to the black display level in correspondence to the black signal in the black insertion writing period K, the potentials of the source lines X1 to Xn are transitioned from the black display level to the intermediate gradation display level in the precharge period P following after the black insertion writing period K. Even when the precharge period P becomes insufficient with respect to a period required for transition from the black-display level to the intermediate gradation display level, the potentials of the source lines X1 to Xn can reach the intermediate gradation display level without fail in the first video signal writing period S1 following after the precharge period P and prevent occurrence of a pixel voltage writing error for the liquid crystal pixels PX. Therefore, occurrence of a lateral stripe can be suppressed when the video signal writing is performed following after the black insertion writing.

When a sufficient black display operation cannot be performed due to insufficient writing in the black insertion writing period K in which the gate lines Yi to Yi+3 are driven, for example, the problem of insufficient writing can be solved by driving the gate lines Yi to Yi+3 again by utilizing a succeeding one of black insertion writing periods K in which the same polarities are set.

Next, a modification of the 4H1V inversion type black insertion driving shown in FIG. 4 is explained with reference to FIG. 5. As shown in FIG. 4, when the four horizontal periods are equally divided into six portions so as to be assigned to the black insertion writing period K, precharge period P and video signal writing periods S1, S2, S3, S4, the black insertion driving is substantially set to a 1.5× speed driving operation and the black insertion writing period K and video signal writing periods S1, S2, S3, S4 become shorter than those of a case shown in FIG. 3. Therefore, a writing error is increased in the display operation other than the solid display operation in which all of the pixels PX are set to the same intermediate gradation luminance level. For example, when a black window is displayed, the whole background thereof is set in the intermediate gradation level in the solid display operation and the boundary line between the black window and the background lies between the horizontal pixel lines corresponding to the gate lines Y2 and Y3, then great transition of the source line potential occurring due to black insertion will occur in the video signal writing period S3 following after the video signal writing period S2 and the horizontal pixel line in which the pixel voltage is insufficiently written will be blurred.

Figure 5:
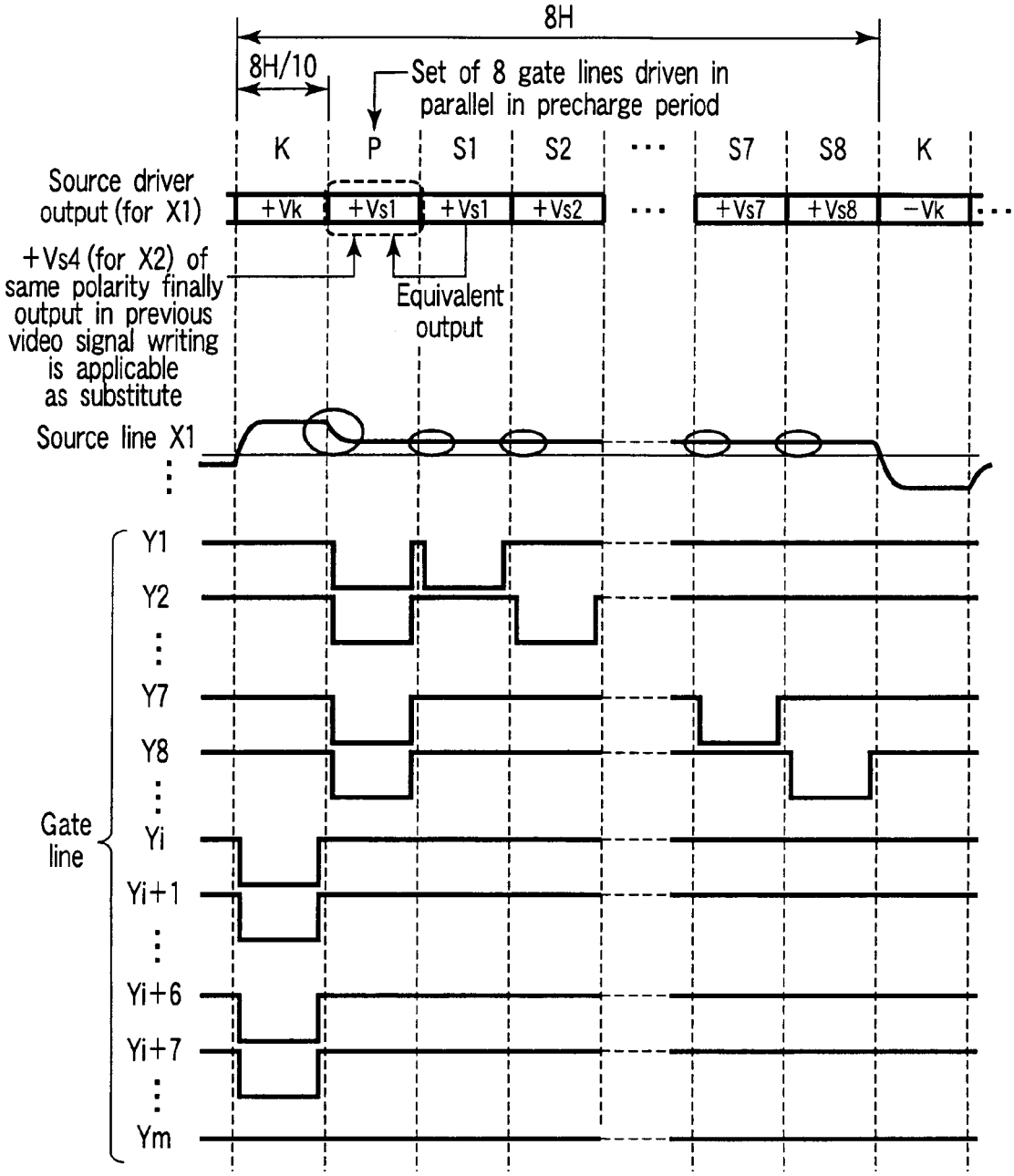
FIG. 5 is a time chart showing a modification of the 4H1V inversion type black insertion driving shown in FIG. 4.

Therefore, in the modification shown in FIG. 5, eight horizontal periods are equally divided into ten portions so as to be assigned to the black insertion writing period K, precharge period P and video signal writing periods S1 to S8. That is, the black insertion writing period K and precharge period P are inserted for every eight horizontal periods. In this case, the black insertion driving can be substantially reduced to 1.25× the speed, like the case of the black insertion driving shown in FIG. 3. Therefore, a lateral stripe occurring due to great transition of the source line potential required in the video signal writing period S1 following after the black insertion writing period K can be eliminated and occurrence of a blur caused by a difference in the video signal writings performed in the video signal writing periods S1 to S8 can be suppressed.

In the modification, the eight gate lines Yi to Yi+7 are driven in parallel in the black insertion writing period K for the black insertion writing of the eight horizontal pixel lines and sequentially driven for video signal writing in the video signal writing periods S1 to S8 again after at least the black insertion period has elapsed after the black insertion writing. However, since the video signal writing is not performed in parallel for the eight horizontal pixel lines, a difference of seven video signal writing periods occurs between the black insertion period of the first horizontal pixel line and the black insertion period of the eighth horizontal pixel line and there occurs a possibility that the difference is recognized as a black stripe due to the luminance difference on the liquid crystal display panel DP. This applies to the eight horizontal pixel lines corresponding to the gate lines Y1 to Y8. Therefore, as shown in FIG. 5, for example, the gate lines Y1 to Y8 are driven in the precharge period P and the video signal writings are sequentially performed for the eight horizontal pixel lines corresponding to the gate lines Y1 to Y8 in the video signal writing periods S1 to S8 following after the precharge period P. In this case, the rates of the black insertion period and the video signal display period can substantially be set equal to each other for all of the eight horizontal pixel lines and an undesired luminance difference occurring between the eight horizontal pixel lines can be prevented from being recognized as a black stripe.

In short, in the 4H1V inversion type black insertion driving operation shown in FIG. 4, none of the gate lines Y1 to Ym is driven in the precharge period P. On the other hand, in the modification shown in FIG. 5, the gate lines Y1 to Ym are driven for every eight lines and the video signal writing corresponding to the precharge signal is temporarily performed for the eight horizontal pixel lines. Thus, in the normal case, the result that an undesired luminance difference occurs when the gate lines of a number exceeding five are driven in parallel for black insertion writing and is recognized as a black stripe will be obtained. However, in this modification, since the video signal writing is also performed in the precharge period P, the above problem can be solved and occurrence of a blur in the boundary with the background at the black window display time can be suppressed.

Next, a liquid crystal display device according to a second embodiment of this invention is explained with reference to the accompanying drawings.

Figure 6:
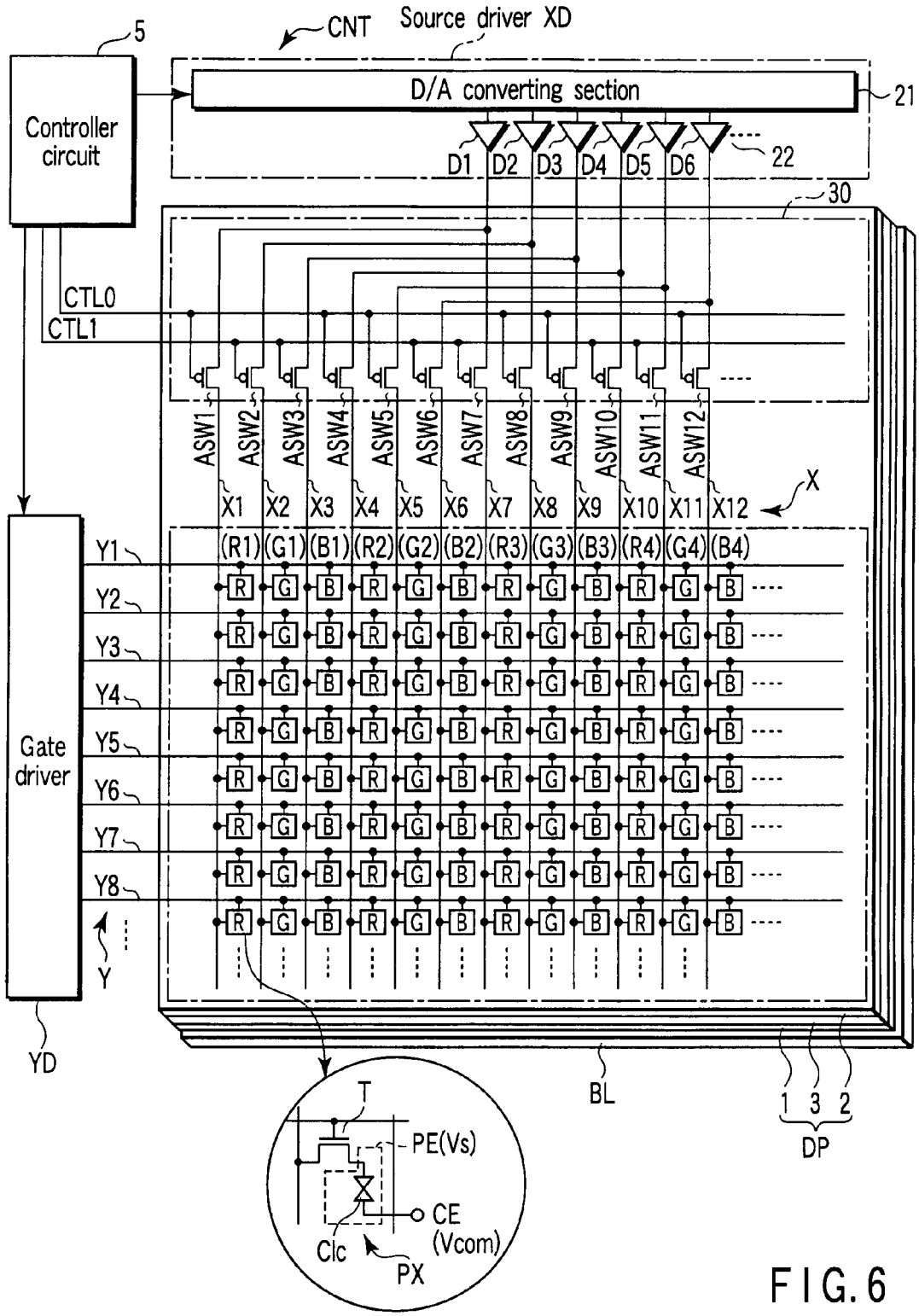
FIG. 6 is a diagram schematically showing the circuit configuration of a liquid crystal display device according to a second embodiment of this invention.

FIG. 6 schematically shows the circuit configuration of the liquid crystal display device. The liquid crystal display device is formed with the same configuration as the liquid crystal display device according to the first embodiment except for the features explained below. In FIG. 6, the same portions as those of the first embodiment are denoted by the same reference symbols and the detailed explanation thereof is omitted.

In the liquid crystal display device shown in FIG. 6, a multiplexer 30 is arranged between the source driver XD and the source lines X1 to Xn. The source driver XD and a gate driver YD may be arranged on a liquid crystal display panel DP like the case of the first embodiment, but in this example, they are arranged outside the liquid crystal display panel DP. the color filter layer CF includes stripe-form red-colored layers, green-colored layers and blue-colored layers which are repeatedly arranged in the row direction in opposition to the columns of pixel electrodes PE. In this example, the red-colored layers are arranged in opposition to the pixel electrodes PE of the first, fourth, seventh, . . . columns and set liquid crystal pixels PX corresponding to the above pixel electrodes PE to red pixels R to form red pixel columns R1, R2, R3, . . . . The green-colored layers are arranged in opposition to the pixel electrodes PE of the second, fifth, eighth, . . . columns and set liquid crystal pixels PX corresponding to the above pixel electrodes PE to green pixels G to form green pixel columns G1, G2, G3, . . . . The blue-colored layers are arranged in opposition to the pixel electrodes PE of the third, sixth, ninth, . . . columns and set liquid crystal pixels PX corresponding to the above pixel electrodes PE to blue pixels B to form blue pixel columns B1, B2, B3, . . . .

The wiring structure of the liquid crystal pixels PX, storage capacitance lines C1 to Cm and storage capacitance Cst are the same as those of the first embodiment, but the wiring structure of the liquid crystal pixels PX in FIG. 6 is drawn in a simplified form and the storage capacitance lines C1 to Cm and storage capacitance Cst are omitted.

The source driver XD is simply explained in the first embodiment, but it actually includes a D/A converting section 21 which converts pixel data items DO for the respective horizontal pixel lines supplied from the controller circuit 5 into pixel voltages Vs, and an output buffer section 22 which respectively outputs the pixel voltages Vs obtained from the D/A converter section 21 to the source lines X1 to Xn. The output buffer section 22 has output buffers D1, D2, D3, D4, . . . of a number which is an integral submultiple, for example, ½ of the total number of source lines X1, X2, X3, . . . as the output terminals of the source driver 20.

The multiplexer 30 is configured to distribute two pixel voltages with the same color and same polarity output from each of the output buffers D1, D2, D3, D4, D5, D6 . . . in two separate cycles to two source lines provided for the respective pixel columns with the same color and same polarity for every six columns via a pair of analog switches. Specifically, analog switches ASW1, ASW4, ASW5, ASW8, ASW9, ASW12, . . . are connected between the source lines X1, X4, X5, X8, X9, X12, . . . of a first source line group and the output buffers D1, D4, D5, D2, D3, D6, . . . and controlled by a control signal CLT0 supplied from the controller circuit 5. Further, the remaining analog switches ASW2, ASW3, ASW6, ASW7, ASW10, ASW11, . . . are connected between the source lines X2, X3, X6, X7, X10, X11, . . . of a second source line group and the output buffers D2, D3, D6, D1, D4, D5, . . . and controlled by a control signal CLT1 supplied from the controller circuit 5. For example, when the control signal CLT0 falls, all of the analog switches ASW1, ASW4, ASW5, ASW8, ASW9, ASW12, . . . are turned on to electrically connect the source lines X1, X4, X5, X8, X9, X12, . . . to the output buffers D1, D4, D5, D2, D3, D6, . . . . Further, when the control signal CLT1 falls, all of the analog switches ASW2, ASW3, ASW6, ASW7, ASW10, ASW11, . . . are turned on to electrically connect the source lines X2, X3, X6, X7, X10, X11, . . . to the output buffers D2, D3, D6, D1, D4, D5, . . . .

Figure 7:
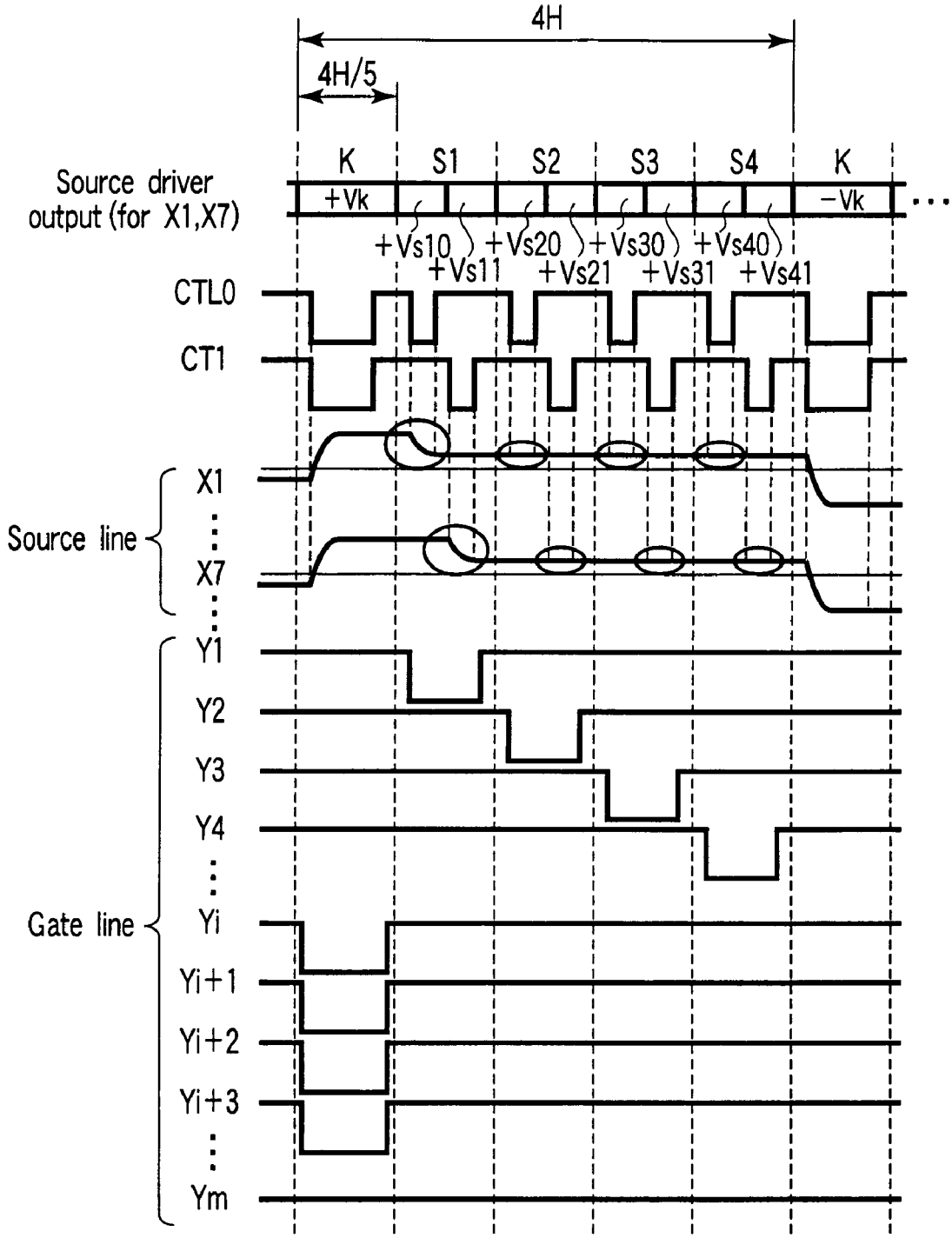
FIG. 7 is a time chart showing a standard 4H1V inversion type black insertion driving performed by use of a multiplexer shown in FIG. 6 as a comparison example.

FIG. 7 shows a standard 4H1V inversion type black insertion driving performed by use of the multiplexer 30 as a comparison example. In the black insertion driving, the black insertion writing and video signal writing are performed for four horizontal pixel lines for every four horizontal periods and the polarities in the black insertion writing and video signal writing are inverted for every four horizontal periods (4H) and for each frame period (1V). The four horizontal periods are equally divided into five portions as shown in FIG. 7, the first 4H/5 period is assigned to the black insertion writing period K and the second, third, fourth and fifth 4H/5 periods are respectively assigned to the video signal writing periods S1, S2, S3, S4. The control signals CLT0, CLT1 fall together in the black insertion writing period K. Further, the control signal CLT0 falls in the first half of each of the video signal writing periods S1, S2, S3, S4 and the control signal CLT0 falls in the latter half of each of the video signal writing periods S1, S2, S3, S4.

In the black insertion writing period K, a black signal is supplied to the source driver XD as pixel data items DO for the respective four horizontal pixel lines. The source driver XD converts the pixel data items DO into black display pixel voltages +Vk, −Vk, +Vk, −Vk, . . . which are set to have the inverted polarities for the respective pixel columns by use of the reference gradation voltages VREF and respectively outputs the black display pixel voltages to the source lines X1 to Xn. On the other hand, the gate driver YD outputs four gate pulses to the four gate lines Yi to Yi+3 during this period of time to turn on all of the pixel switching elements T connected to the gate lines Yi to Yi+3. Further, since the control signals CLT0, CLT1 fall together, the black display pixel voltages +Vk, −Vk, +Vk, −Vk, . . . are applied to the pixels PX of each of the four horizontal pixel lines from the source lines X1 to Xn via the switching elements T during this period of time. Like the first embodiment, in the present embodiment, each of the gate lines Y1 to Ym is driven upon a fall of the gate pulse in opposition to the case of FIG. 13.

In the first half of the video signal writing period S1, a video signal is supplied to the source driver XD as pixel data items DO for half of the first horizontal pixel line among the four horizontal pixel lines different from those used in the black insertion writing. The source driver XD converts the pixel data items DO into video display pixel voltages +Vs10, −Vs10, +Vs10, −Vs10, . . . which are set to have the inverted polarities for the respective pixel columns by use of the reference gradation voltages VREF and respectively outputs the video display pixel voltages from the output buffers D1, D2, D3, D4, D5, D6, . . . . The video display pixel voltages +Vs10, −Vs10, +Vs10, −Vs10, . . . are supplied to the source lines X1, X4, X5, X8, X9, X12, . . . via the analog switches ASW1, ASW4, ASW5, ASW8, ASW9, ASW12, . . . . In the latter half of the video signal writing period S1, a video signal is supplied to the source driver XD as pixel data items DO for the remaining half of the first horizontal pixel line. The source driver XD converts the pixel data items DO into video display pixel voltages +Vs11, −Vs11, +Vs11, −Vs11, . . . which are set to have the inverted polarities for the respective pixel columns by use of the reference gradation voltages VREF and respectively outputs the video display pixel voltages from the output buffers D1, D2, D3, D4, D5, D6, . . . . The video display pixel voltages +Vs11, −Vs11, +Vs11, −Vs11, . . . are supplied to the source lines X2, X3, X6, X7, X10, X11, . . . via the analog switches ASW2, ASW3, ASW6, ASW7, ASW10, ASW11, . . . . On the other hand, the gate driver YD continuously outputs a single gate pulse to the gate line Y1, for example, in the video signal writing period S1 to turn on all of the pixel switching elements T connected to the gate line Y1. Thus, the video display pixel voltages +Vs10, −Vs10, +Vs10, −Vs10, . . . are applied to the corresponding pixels PX of half of the first horizontal pixel line from the source lines X1, X4, X5, X8, X9, X12, . . . in the first half of the video signal writing period S1. Further, the video display pixel voltages +Vs11, −Vs11, +Vs11, −Vs11, . . . are applied to the corresponding pixels PX of the remaining half of the first horizontal pixel line from the source lines X2, X3, X6, X7, X10, X11, . . . in the latter half of the video signal writing period S1. The operations in the succeeding video signal writing periods S2, S3, S4 are performed by repeatedly performing the same operation as that in the video signal writing period S1.

As a result, video display pixel voltages +Vs20, −Vs20, +Vs20, −Vs20, . . . are applied to the corresponding pixels PX of half of the second horizontal pixel line from the source lines X1, X4, X5, X8, X9, X12, . . . in the first half of the video signal writing period S2. Further, video display pixel voltages +Vs21, −Vs21, +Vs21, −Vs21, . . . are applied to the corresponding pixels PX of the remaining half of the second horizontal pixel line from the source lines X2, X3, X6, X7, X10, X11, . . . in the latter half of the video signal writing period S2.

Then, video display pixel voltages +Vs30, −Vs30, +Vs30, −Vs30, . . . are applied to the corresponding pixels PX of half of the third horizontal pixel line from the source lines X1, X4, X5, X8, X9, X12, . . . in the first half of the video signal writing period S3. Further, video display pixel voltages +Vs31, −Vs31, +Vs31, −Vs31, . . . are applied to the corresponding pixels PX of the remaining half of the third horizontal pixel line from the source lines X2, X3, X6, X7, X10, X11, . . . in the latter half of the video signal writing period S3.

Next, video display pixel voltages +Vs40, −Vs40, +Vs40, −Vs40, . . . are applied to the corresponding pixels PX of half of the fourth horizontal pixel line from the source lines X1, X4, X5, X8, X9, X12, . . . in the first half of the video signal writing period S4. Further, video display pixel voltages +Vs41, −Vs41, +Vs41, −Vs41, . . . are applied to the corresponding pixels PX of the remaining half of the third horizontal pixel line from the source lines X2, X3, X6, X7, X10, X11, . . . in the latter half of the video signal writing period S4.

The above operations are performed in units of four horizontal periods while the pixel voltage polarities are being inverted. Further, the pixel voltage polarities are inverted in units of one frame period. In this case, the black insertion period from the black insertion writing of the first horizontal pixel line to the video signal writing of the first horizontal pixel line is set to approximately 20% of one frame period.

In the black insertion driving shown in FIG. 7, attention is paid to the potentials of the source lines X1, X7. The potentials of the source lines X1, X7 are mainly transitioned in portions near circular marks indicated in FIG. 7 after they are set to the pixel voltage +Vk in the black insertion writing period K. That is, the potential of the source line X1 transitions from a level equal to the pixel voltage +Vk to a level equal to the pixel voltage +Vs10 in the first half of the first video signal writing period S1, transitions from the level equal to the pixel voltage +Vs10 to a level equal to the pixel voltage +Vs20 in the first half of the second video signal writing period S2, transitions from the level equal to the pixel voltage +Vs20 to a level equal to the pixel voltage +Vs30 in the first half of the third video signal writing period S3 and transitions from the level equal to the pixel voltage +Vs30 to a level equal to the pixel voltage +Vs40 in the first half of the fourth video signal writing period S4. Further, the potential of the source line X1 transitions from the level equal to the pixel voltage +Vk to a level equal to the pixel voltage +Vs11 in the latter half of the first video signal writing period S1, transitions from the level equal to the pixel voltage +Vs11 to a level equal to the pixel voltage +Vs21 in the latter half of the second video signal writing period S2, transitions from the level equal to the pixel voltage +Vs21 to a level equal to the pixel voltage +Vs31 in the latter half of the third video signal writing period S3 and transitions from the level equal to the pixel voltage +Vs31 to a level equal to the pixel voltage +Vs41 in the latter half of the fourth video signal writing period S4.

The pixel voltage +Vk is set at the maximum level used for black display and the pixel voltages +Vs10, +Vs11 are set at a level lower than the maximum level and used for display of a video signal which is mainly set at an intermediate gradation level. Therefore, the potential difference between +Vk and +Vs10 is set larger than the potential differences between +Vs10 and +Vs20, between +Vs20 and +Vs30 and between +Vs30 and +Vs40 and the transition time in the first half of the video signal writing period S1 becomes longer than the transition time in the first half of each of the video signal writing periods S2, S3, S4. Further, the potential difference between +Vk and +Vs11 is set larger than the potential differences between +Vs11 and +Vs21, between +Vs21 and +Vs31 and between +Vs31 and +Vs41 and the transition time in the latter half of the video signal writing period S1 becomes longer than the transition time in the latter half of each of the video signal writing periods S2, S3, S4. Thus, when the time constants of the source lines X1, X7 used as the load of the source driver XD are large, the first half and latter half of the video signal writing period S1 are terminated during the potential transition of the source lines X1, X7 and a pixel voltage writing error will occur. Since each of the first half and latter half of the video signal writing period S1 is set to a 4H/10 period, the pixel voltage writing error becomes significant. Therefore, occurrence of a lateral stripe becomes serious due to utilization of the multiplxer 30.

Figure 8:
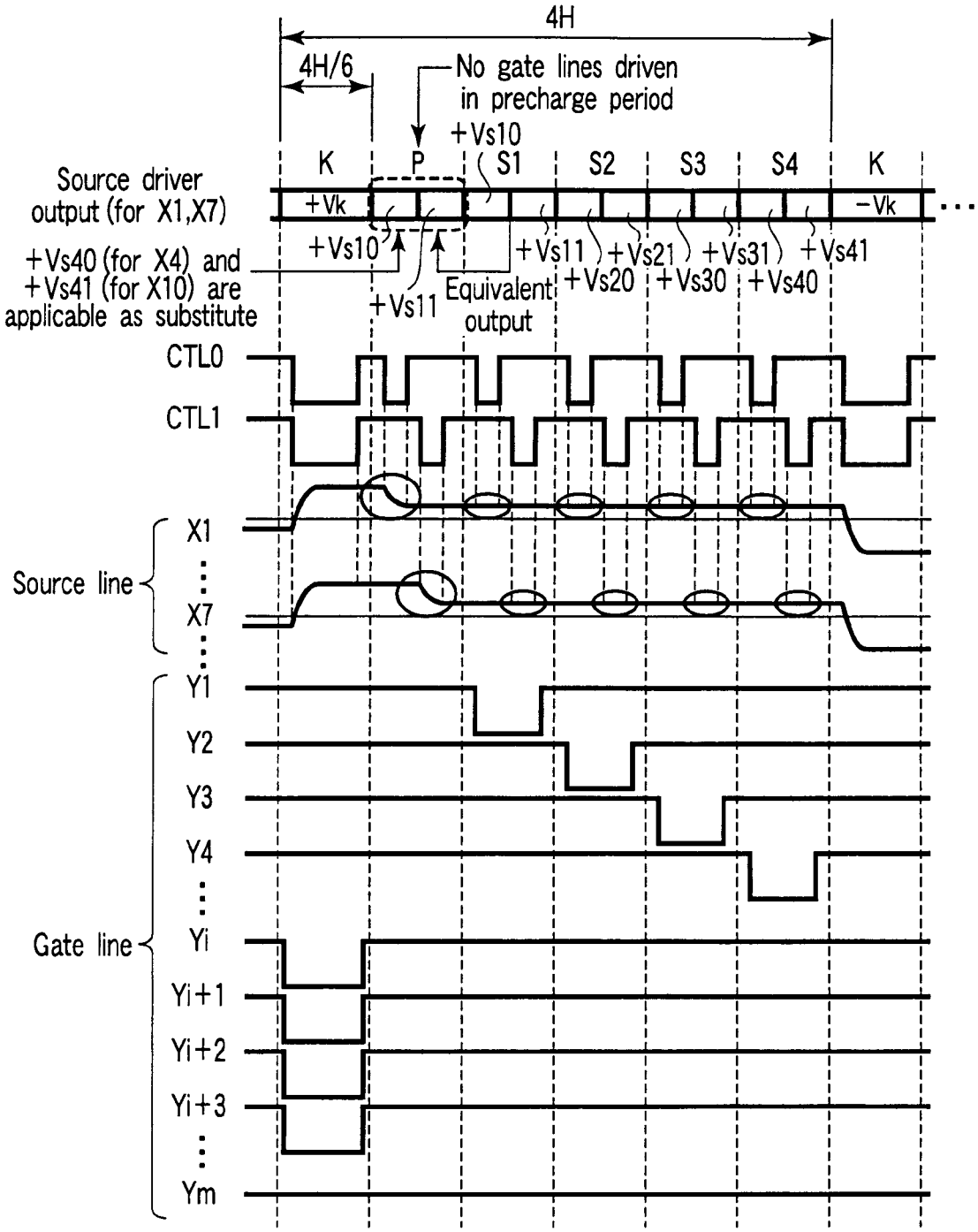
FIG. 8 is a time chart showing a 4H1V inversion type black insertion driving performed by a display control circuit shown in FIG. 6.

The display control circuit CNT shown in FIG. 6 performs a 4H1V inversion type black insertion driving shown in FIG. 8 in order to prevent occurrence of the above writing error. Like the black insertion driving shown in FIG. 7, in the above black insertion driving, the black insertion writing and video signal writing operation are performed for four horizontal pixel lines for every four horizontal periods and the polarities in the black insertion writing and video signal writing are inverted for every four horizontal periods (4H) and for each frame period (1V). In this case, as shown in FIG. 8, the four horizontal periods are equally divided into six portions, the first 4H/6 period is assigned to the black insertion writing period K, the second 4H/6 period is assigned to the precharge period P and the third, fourth, fifth and sixth 4H/6 periods are respectively assigned to the video signal writing periods S1, S2, S3, S4. That is, the display control circuit CNT is configured to provide a precharge period P between the black insertion writing period K in which the four gate lines Yi to Yi+3 are driven for black insertion writing and the video signal writing period S1 in which one of the four gate lines Y1 to Y4 is initially driven for video signal writing after the black insertion writing period K and transition respective halves of the potentials of the source lines X1 to Xn to intermediate gradation display levels in the first half and latter half of the precharge period P.

The source driver XD and gate driver YD are operated in the black insertion writing period K and video signal writing periods S1, S2, S3, S3 like the case of the 4H1V inversion type black insertion driving operation shown in FIG. 7. On the other hand, in the first half of the precharge period P, a precharge signal is supplied to the source driver XD as pixel data items DO assigned to half of the source lines X1 to Xn. For example, the source driver XD converts the pixel data items DO into video display pixel voltages +Vs10, −Vs10, +Vs10, −Vs10, . . . which are set to have the inverted polarities for the respective pixel columns by use of the reference gradation voltages VREF and respectively outputs the video display pixel voltages from the output buffers D1, D2, D3, D4, D5, D6, . . . . The video display pixel voltages +Vs10, −Vs10, +Vs10, −Vs10, . . . are supplied to the source lines X1, X4, X5, X8, X9, X12, . . . via the analog switches ASW1, ASW4, ASW5, ASW8, ASW9, ASW12, . . . . In the latter half of the precharge period P, a precharge signal is supplied to the source driver XD as pixel data items DO assigned to the remaining half of the source lines X1 to Xn. The source driver XD converts the pixel data items DO into video display pixel voltages +Vs11, −Vs11, +Vs11, −Vs11, . . . which are set to have the inverted polarities for the respective pixel columns by use of the reference gradation voltages VREF and respectively outputs the video display pixel voltages from the output buffers D1, D2, D3, D4, D5, D6, . . . . The video display pixel voltages +Vs11, −Vs11, +Vs11, −Vs11, . . . are supplied to the source lines X2, X3, X6, X7, X10, X11, . . . via the analog switches ASW2, ASW3, ASW6, ASW7, ASW10, ASW11, . . . . In this case, the gate driver YD outputs no gate pulse to the gate lines Y1 to Ym, for example, in the first half and latter half of the precharge period and maintains all of the pixel switching elements T connected to the gate lines Y1 to Ym in the OFF state. The precharge signal is used to previously transition the potentials of half of the source lines X1 to Xn and the potentials of the remaining half thereof towards an intermediate gradation display level closer to the video display level rather than the black display level in the first half and latter half of the precharge period P. In this example, the video display pixel voltages +Vs10, −Vs10, +Vs10, −Vs10, . . . and the video display pixel voltages +Vs11, −Vs11, +Vs11, −Vs11, . . . are respectively output to the source lines X1, X4, X5, X8, X9, X12 . . . and source lines X2, X3, X6, X7, X10, X11 . . . in the first half and latter half of the precharge period P1 as an example in which the intermediate gradation display levels equivalent to levels at which the pixel voltages are set in the first half and latter half of the video signal writing period S1.

The potentials of the source lines X1, X7 are transitioned from a level equal to the pixel voltage +Vk towards levels equal to the pixel voltages +Vs10, +Vs11 in the first half and the later half of the precharge period P. Even when the first half and latter half of the precharge period P are terminated in the course of the potential transition, the potentials of the source lines X1, X7 are further transitioned towards the levels equal to the pixel voltages +Vs10, +Vs11 in the first half and the later half of the video signal writing period S1. The length of each of the first half and latter half of the video signal writing period S1 shown in FIG. 8 is set to the length of the 4H/12 period which is shorter than the 4H/10 period assigned to each of the first half and latter half of the video signal writing period S1 shown in FIG. 7, but the length of the 4H/12 period which is assigned to each of the first half and latter half of the precharge period P is added to the length of the first half and latter half of the video signal writing period S1 and it is only required for the potentials of the source lines X1, X7 to transition from the level equal to the pixel voltage +Vk to levels equal to the pixel voltages +Vs10, +Vs11 in the total period of 8H/12 (=4H/6 period). Thus, it becomes possible to transition the potentials of the source lines X1, X7 to the levels equal to the pixel voltages +Vs10, +Vs11 without fail until the end of the first half and latter half of the video signal writing period S1 and prevent occurrence of an error in the writing operation of the pixel voltages +Vs10, +Vs11 performed by use of the source lines X1, X7. This can apply to the remaining source lines.

The source driver XP may output pixel voltages other than the pixel voltages +Vs10, −Vs10, +Vs10, −Vs10, . . . to the source lines X1, X4, X5, X8, X9, X12, . . . in the first half of the precharge period P and transition the potentials of the source lines X1, X4, X5, X8, X9, X12, . . . to desired intermediate gradation display levels which are closer to the video display level rather than the black display level. Further, the source driver XP may output pixel voltages other than the pixel voltages +Vs11, −Vs11, +Vs11, −Vs11, . . . to the source lines X2, X3, X6, X7, X10, X11, . . . in the latter half of the precharge period P and transition the potentials of the source lines X2, X3, X6, X7, X10, X11, . . . to desired intermediate gradation display levels which are closer to the video display level rather than the black display level. Generally, a frame memory is required in order to serve the above purpose, but the frame memory can be made unnecessary by outputting the pixel voltages +Vs10, −Vs10, +Vs10, −Vs10, . . . and the pixel voltages +Vs11, −Vs11, +Vs11, −Vs11, . . . in the first half and latter half of the precharge period P as described above or performing the operation explained as follows.

Although not shown in FIG. 8, for example, video display pixel voltages −Vs40, +Vs40, −Vs40, +Vs40 . . . and video display pixel voltages −Vs41, +Vs41, −Vs41, +Vs41 . . . which are set to have inverted polarities are output from the source driver XP to the source lines X1, X4, X5, X8, X9, X12, . . . and source lines X2, X3, X6, X7, X10, X11, . . . in the first half and latter half of the final video signal writing period S4 preceding the black insertion writing period K in which the black display pixel voltages +Vk, −Vk, +Vk, −Vk, . . . are output from the source driver XD. For example, when all of the pixels PX perform the same intermediate gradation display operation according to the video signal, the pixel voltages −Vs40, +Vs40, −Vs40, +Vs40, . . . and pixel voltages −Vs41, +Vs41, −Vs41, +Vs41 . . . are the same as the video display pixel voltages +Vs10, −Vs10, +Vs10, −Vs10, . . . and pixel voltages +Vs11, −Vs11, +Vs11, −Vs11, . . . output to the source lines X1, X4, X5, X8, X9, X12, . . . and source lines X2, X3, X6, X7, X10, X11, . . . in the first half and latter half of the video signal writing period S1 except that the polarities thereof are inverted. Therefore, if the polarities are respectively set equal to the corresponding polarities, the pixel voltages can be substituted as the pixel voltages +Vs10, −Vs10, +Vs10, −Vs10, and pixel voltages +Vs11, −Vs11, +Vs11, −Vs11, output in the first half and latter half of the precharge period P. In this case, for example, the pixel voltage +Vs40 for the source line X4 is output to the source line X1 and the pixel voltage +Vs41 for the source line X7 is output to the source line X1.

As described above, in the second embodiment, a precharge period P is provided between the black insertion writing period K in which the four gate lines Yi to Yi+3 are driven for black insertion writing and the video signal writing period S1 in which one of the four gate lines Y1 to Y4 is initially driven for video signal writing after the black insertion writing period K and the potentials of the source lines X1, X4, X5, X8, X9, X12, . . . and source lines X2, X3, X6, X7, X10, X11, . . . are set to the intermediate gradation display levels in the first half and latter half of the precharge period P. When, for example, the potentials of the source lines X1 to Xn are set to the black display level according to the black signal in the black insertion writing period K, the potentials of the source lines X1, X4, X5, X8, X9, X12, . . . and the potentials of the source lines X2, X3, X6, X7, X10, X11, . . . are transitioned from the black display level to the intermediate gradation display levels in the first half and latter half of the precharge period P following after the black insertion writing period K. Even when the first half and latter half of the precharge period P become insufficient with respect to a period required for transition from the black-display level to the intermediate gradation display level, the potentials of the source lines X1, X4, X5, X8, X9, X12, . . . and the potentials of the source lines X2, X3, X6, X7, X10, X11, . . . can reach the intermediate gradation display levels without fail in the first half and latter half of the first video signal writing period S1 following after the precharge period P and prevent occurrence of a writing error of the pixel voltages for the liquid crystal pixels PX. Therefore, occurrence of a lateral stripe caused when the video signal writing is performed after the black insertion writing can be suppressed, like the case of the first embodiment.

When a sufficient black display operation cannot be performed due to insufficient writing in the black insertion writing period K in which the gate lines Yi to Yi+3 are driven, for example, the problem of insufficient writing can be solved by driving the gate lines Yi to Yi+3 again by utilizing a succeeding one of black insertion writing periods K in which the same polarities are set, as is explained in the first embodiment.

Figure 9:
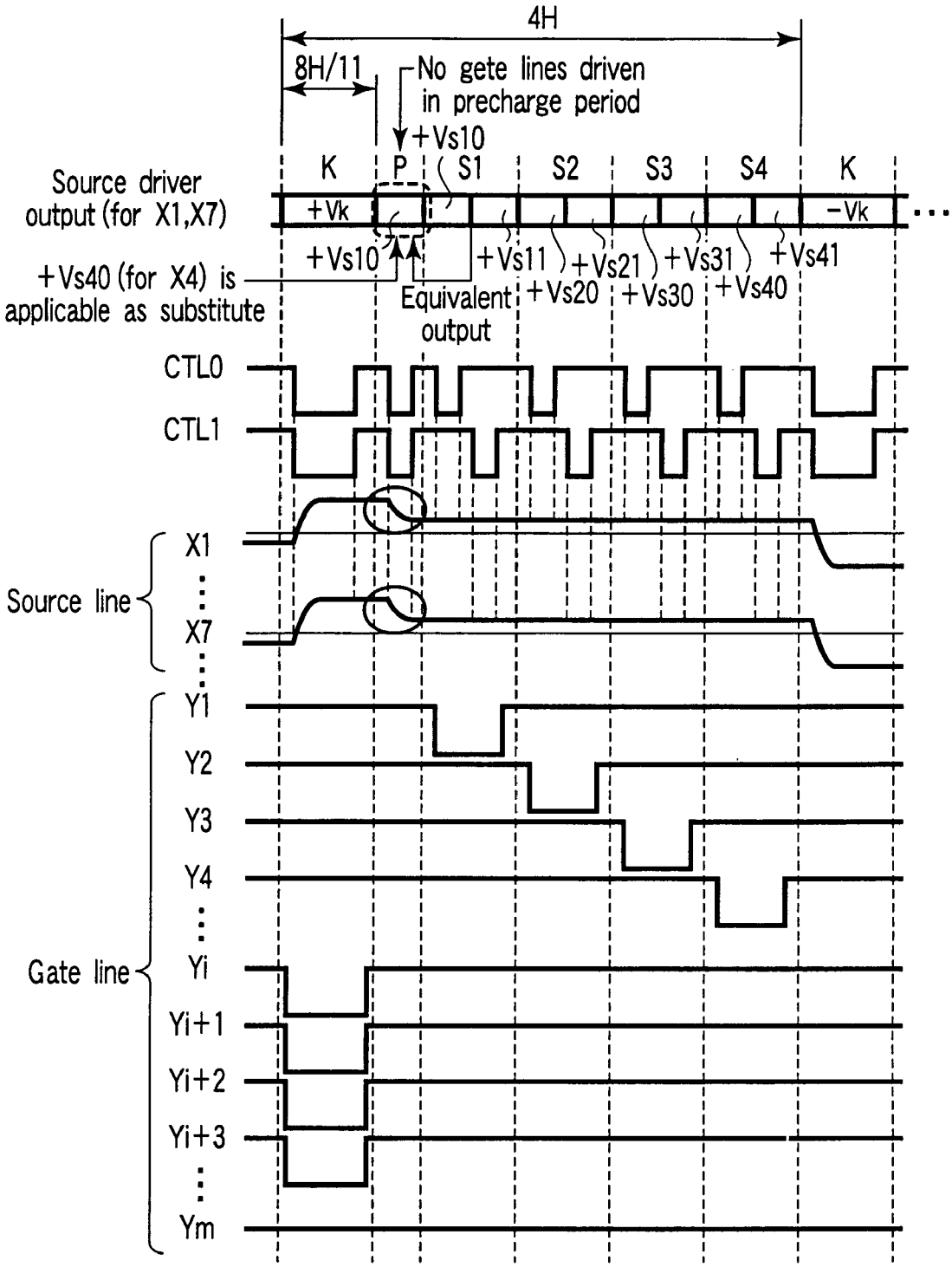
FIG. 9 is a time chart showing a first modification of the 4H1V inversion type black insertion driving shown in FIG. 8.

Next, a first modification of the 4H1V inversion type black insertion driving shown in FIG. 8 is explained with reference to FIG. 9. In this modification, the precharge period P is not divided into the first-half and latter-half portions shown in FIG. 8 and is set to the length smaller than the black insertion writing period K and each of the video signal writing periods S1, S2, S3, S4, for example, half the length thereof (=4H/11) as shown in FIG. 9. Specifically, like the black insertion driving shown in FIG. 8, the black insertion writing and video signal writing are performed for four horizontal pixel lines for every four horizontal periods and the polarities in the black insertion writing and video signal writing are inverted for every four horizontal periods (4H) and for each frame period (1V). In this case, as shown in FIG. 9, the four horizontal periods are substantially equally divided into eleven portions, the first 8H/11 period is assigned to the black insertion writing period K, the second 4H/11 period is assigned to the precharge period P and the succeeding four 8H/11 periods are respectively assigned to the video signal writing periods S1, S2, S3, S4. That is, the display control circuit CNT is configured to provide a precharge period P between the black insertion writing period K, in which the four gate lines Yi to Yi+3 are driven for black insertion writing, and the video signal writing period S1, in which one of the four gate lines Y1 to Y4 is initially driven for video signal writing after the black insertion writing period K and set the potentials of the source lines X1 to Xn to intermediate gradation display levels in the precharge period P. Therefore, the gate driver YD outputs no gate pulse to the gate lines Y1 to Ym in the precharge period P to maintain all of the pixel switching elements T connected to the gate lines Y1 to Ym in the OFF state. The precharge signal is used to previously transition the potentials of the source lines X1 to Xn towards an intermediate gradation display level closer to the video display level rather than the black display level in the precharge period P. In this example, the video display pixel voltages +Vs10, −Vs10, +Vs10, −Vs10, . . . are respectively output from the output buffers D1, D2, D3, D4, D5, D6, . . . to the source lines X1, X4, X5, X8, X9, X12 . . . and source lines X2, X3, X6, X7, X10, X11 . . . in the precharge period P1 as an example in which the intermediate gradation display levels approximately equal to levels set in the first half and latter half of the video signal writing period S1 are obtained. The control signals CLT0, CLT1 fall together in the precharge period P. Thus, the pixel voltages +Vs10, −Vs10, +Vs10, −Vs10, . . . are supplied to the source lines X1, X4, X5, X8, X9, X12, . . . via the analog switches ASW1, ASW4, ASW5, ASW8, ASW9, ASW12, . . . and supplied to the source lines X2, X3, X6, X7, X10, X11, . . . via the analog switches ASW2, ASW3, ASW6, ASW7, ASW10, ASW11, . . . . Now, attention is paid to the potentials of the source lines X1, X7. The potentials of the source lines X1, X7 are transitioned together in portions near circular marks indicated in FIG. 9 in the precharge period P after the potentials are set to the pixel voltage +Vk in the black insertion writing period K.

In the first modification, since the precharge period P is set to half the length of the precharge period set in the case of the black insertion driving operation shown in FIG. 8, the lengths of the black insertion writing period K and the video signal writing periods S1, S2, S3, S4 are prevented from being unnecessarily compressed. As a result, the speed of the black insertion driving operation can be reduced to 1.375× the speed. Therefore, occurrence of a blur in the boundary portion at the black window display time can be markedly suppressed in comparison with a case of the black insertion driving shown in FIG. 8.

In the precharge period P, the video display pixel voltages +Vs10, −Vs10, +Vs10, −Vs10, . . . are output from the output buffers D1, D2, D3, D4, D5, D6, . . . . However, for example, when all of the pixels PX perform the same intermediate gradation display operation according to the video signal, the video display pixel voltages −Vs40, +Vs40, −Vs40, +Vs40, . . . explained in the second embodiment may be used.

Figure 10:
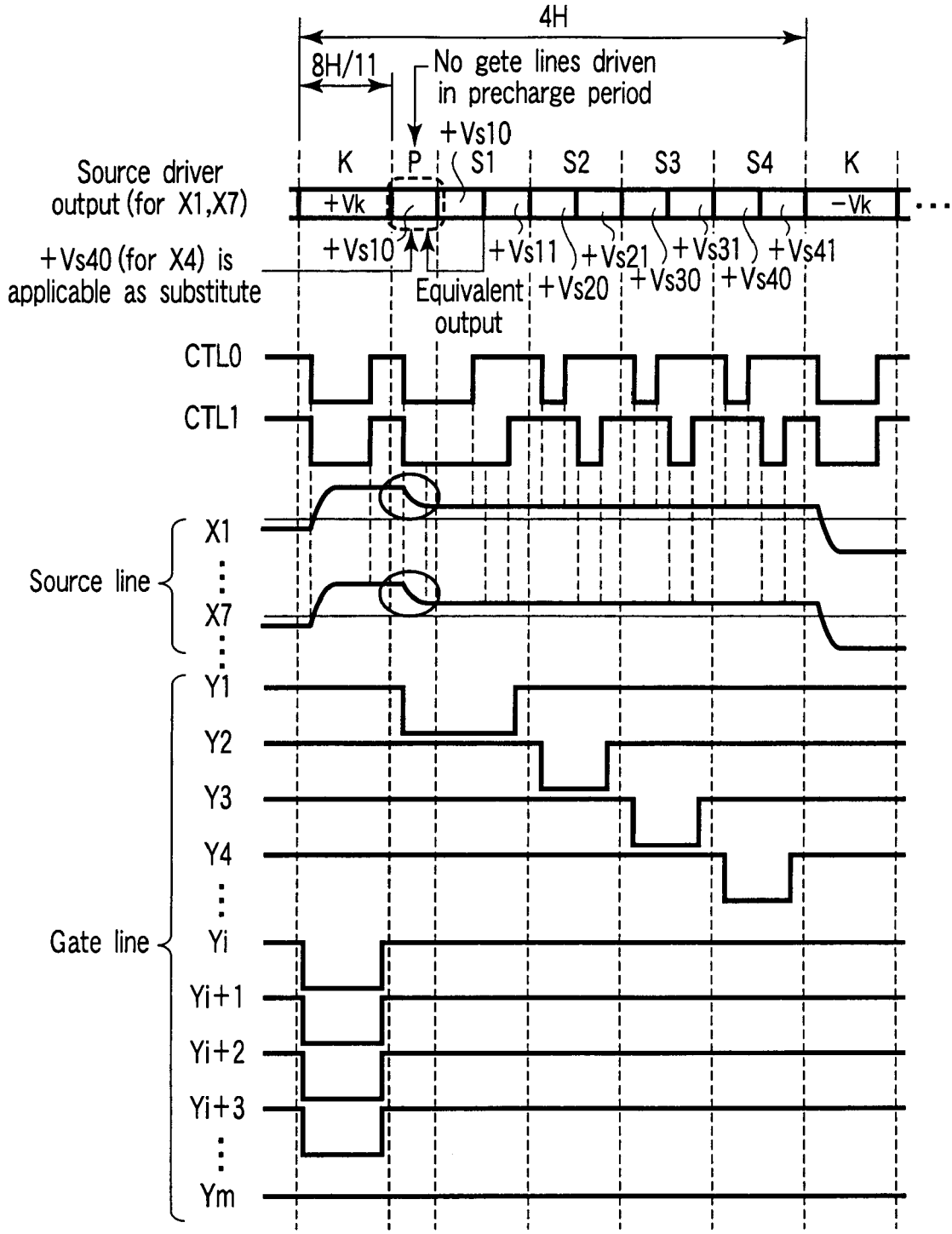
FIG. 10 is a time chart showing a second modification of the 4H1V inversion type black insertion driving shown in FIG. 8.

FIG. 10 shows a second modification of the 4H1V inversion type black insertion driving shown in FIG. 8. The second modification is similar to the first modification of FIG. 9 except for the following features. That is, when the control signals CLT0, CLT1 fall in the precharge period P, the state is maintained until the first half and latter half of the video signal writing period S1. Further, the gate driver YD continuously outputs a gate pulse to a gate line Y corresponding to one horizontal pixel line which is subjected to the video signal writing in the video signal writing period S1 in a period from the precharge period P to the video signal writing period S1.

Even when the 4H1V inversion type black insertion driving is performed as in the second modification, the same effect as that obtained in the first modification can be attained.

Figure 11:
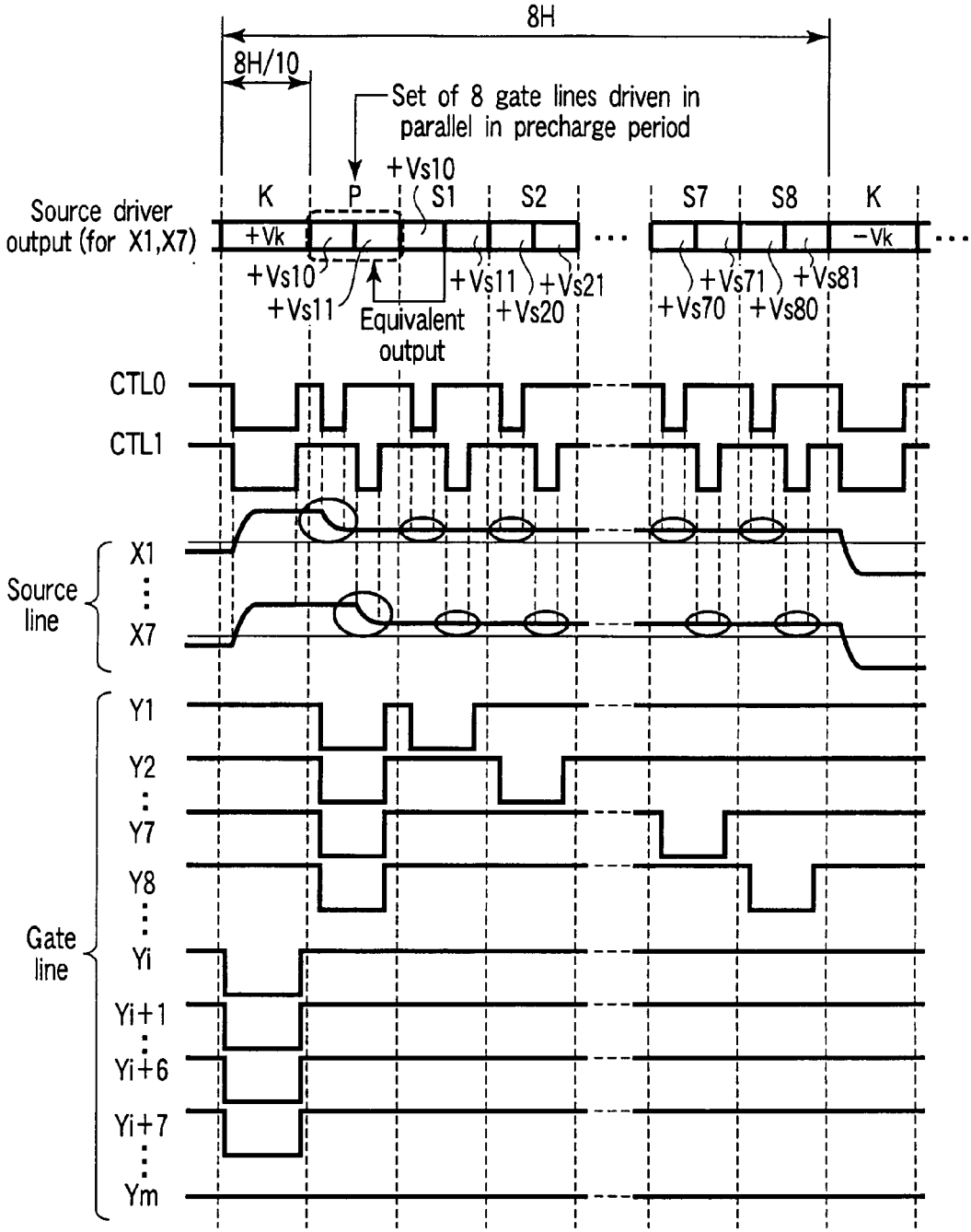
FIG. 11 is a time chart showing a third modification of the 4H1V inversion type black insertion driving shown in FIG. 8.

FIG. 11 shows a third modification of the 4H1V inversion type black insertion driving shown in FIG. 8. The third modification is obtained by changing the 4H1V inversion type shown in FIG. 8 into an 8H1V inversion type for the same reason as explained in the black insertion driving shown in FIG. 5.

In the third modification, eight horizontal periods are equally divided into ten portions so as to be assigned to the black insertion writing period K, precharge period P and video signal writing periods S1 to S8. That is, the black insertion writing period K and precharge period P are inserted for every eight horizontal periods. In this case, the speed of the black insertion driving operation can be substantially reduced to 1.25× the speed, like the case of the black insertion driving shown in FIG. 3. Therefore, a lateral stripe caused due to great transition of the source line potential required in the video signal writing period S1 following after the black insertion writing period K can be eliminated and occurrence of a blur caused by a difference in the video signal writings performed in the video signal writing periods S1 to S8 can be suppressed.

This invention is not limited to the above embodiments and can be variously modified without departing from the technical scope thereof.

The above embodiments and modifications may be selectively combined as required, for example.

Figure 12:
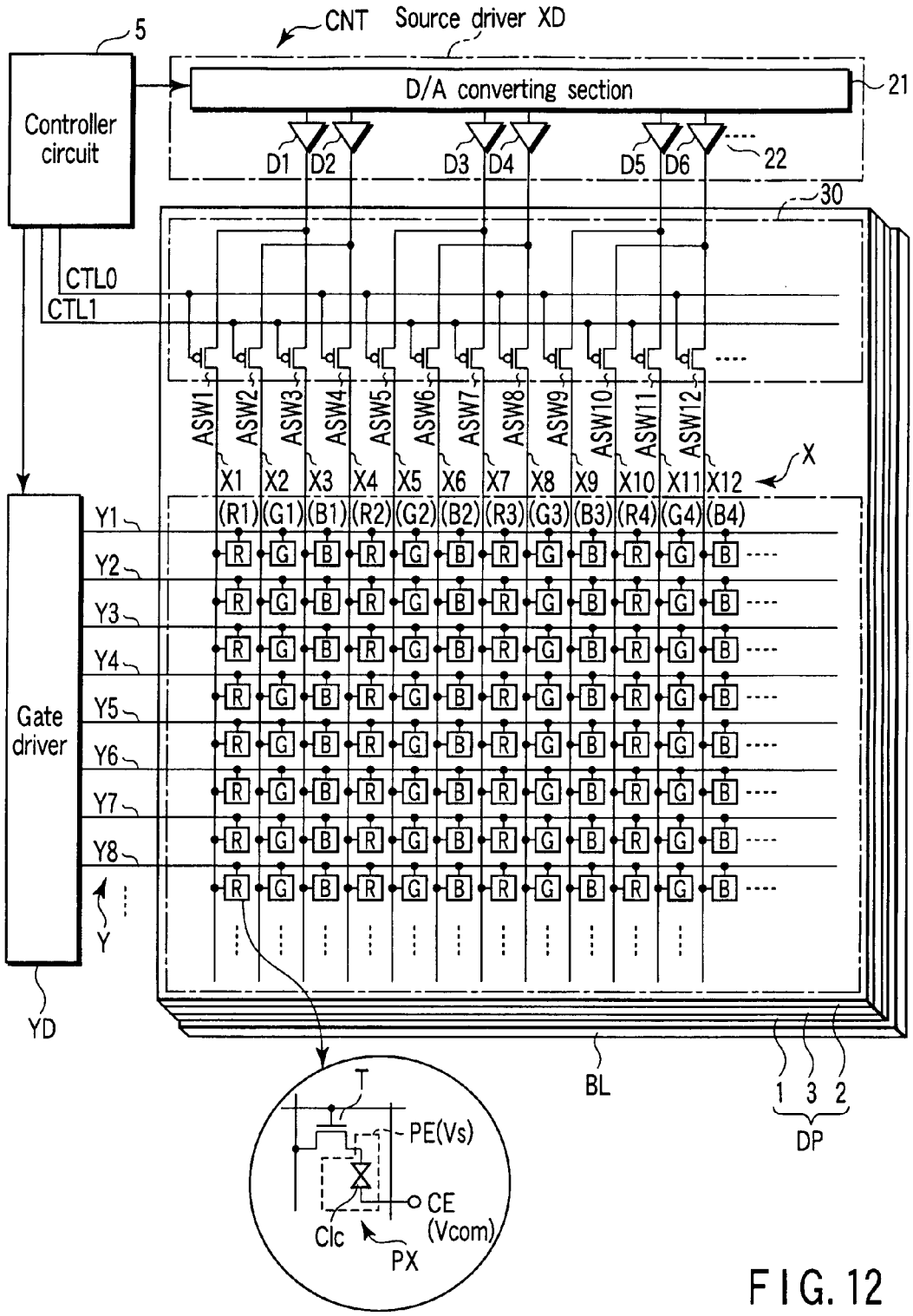
FIG. 12 is a diagram showing an example in which the multiplexer shown in FIG. 6 is modified into a cross-select system.

Further, the multiplexer 30 shown in FIG. 6 is configured to distribute two pixel voltages with the same color and same polarity output in two separate cycles from each of the output buffers D1, D2, D3, D4, D5, D6, . . . to two source lines provided for the pixel columns of the same color and same polarity for every six columns via a pair of analog switches. That is, it is preferable to match potentials set on the source lines X1 to Xn in the precharge period P to colors and driving polarities of liquid crystal pixels PX to which the potentials of the source lines X1 to Xn are applied as shown in FIG. 6, but the effect of this invention can be attained irrespective of the matching degree of colors. Therefore, the multiplexer 30 can be modified into a cross-select type multiplexer shown in FIG. 12, for example. In this case, the multiplexer 30 is configured to distribute two pixel voltages with the same polarity output in two separate cycles from each of the output buffers D1, D2, D3, D4, D5, D6, . . . to two source lines provided for the pixel columns of the same polarity for every other column via a pair of analog switches. Also, the multiplexer 30 may be configured not only to selectively distribute an output of each output buffer to two source lines, but also to selectively distribute the output to three, four or more source lines.

In the above embodiments, the 4H1V or 8H1V inversion type black insertion driving is explained. However, the effect of this invention can be attained in another black insertion driving, which is an (n+1)/nX speed driving operation in which the (n+1) writing operations (one black insertion writing operation and n video signal writing operations) are performed for every n horizontal periods when n is set as a natural number as explained in "BACKGROUND OF THE INVENTION" if the precharge period P is provided between the black insertion writing period and the initial video signal writing period following after the above writing period in the black insertion driving operation.

Further, in the above embodiments, the liquid crystal display panel is of the OCB mode in which the black insertion driving is performed in order to prevent the reverse transition of the liquid crystal molecules from the bend alignment to the splay alignment. However, this invention can be applied to a liquid crystal display panel of, for example, TN mode, MVA mode, IPS mode, PVA mode, ASV mode or another liquid crystal mode in which the video signal writing operation is performed after the non-video signal writing operation.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A liquid crystal display device comprising:

a liquid crystal display panel having a plurality of liquid crystal pixels arranged in a matrix form, a plurality of gate lines arranged along the rows of liquid crystal pixels, a plurality of source lines arranged along the columns of liquid crystal pixels and a plurality of pixel switching elements which are arranged near intersections between the gate lines and the source lines and each of which applies the potential of a corresponding one of the source lines as a pixel voltage to a corresponding one of the liquid crystal pixels when driven via a corresponding one of the gate lines; and a display control circuit which performs non-video signal writing for driving the source lines according to a non-video signal while the gate lines are being driven in parallel for every preset number and performs video signal writing for driving the source lines according to a video signal while the gate lines are being sequentially driven for every preset number;

wherein the display control circuit is configured to provide a precharge period between a non-video signal writing period in which a preset number of gate lines are driven for the non-video signal writing and a video signal writing period in which one of the preset number of gate lines is initially driven for the video signal writing after the non-video signal writing period and transition the potentials of the source lines to a level which is close to an intermediate gradation display level corresponding to the video signal in the precharge period.

2. The liquid crystal display device according to claim 1, wherein the display control circuit includes a source driver which outputs the same voltage as one of the voltage output in the initial video signal writing period and voltage output in a final video signal writing period which precedes the non-video signal writing period to the source lines in the precharge period.

3. The liquid crystal display device according to claim 2, wherein the display control circuit includes a multiplexer which assigns each output terminal of the source driver to two or more source lines and distributes voltages sequentially output from the output terminal to the two or more source lines in at least the video signal writing period.

4. The liquid crystal display device according to claim 3, wherein the multiplexer is configured to distribute a single voltage output from the output terminal to the two or more source lines in the precharge period.

5. The liquid crystal display device according to claim 4, wherein the two or more source lines are combined for the liquid crystal pixels which require video signal writing of the same color and same polarity.

6. The liquid crystal display device according to claim 4, wherein the display control circuit includes a gate driver which simultaneously drives in the precharge period a preset number of gate lines, which are sequentially driven for the video signal writing following after the precharge period.

7. The liquid crystal display device according to claim 6, wherein the gate driver is configured to continuously drive a corresponding one of the gate lines from the precharge period to the initial video signal writing period.

8. The liquid crystal display device according to claim 4, wherein the gate lines are driven in parallel for every preset number which is not less than five for the non-video signal writing and sequentially driven for the video signal writing.

9. A liquid crystal display device comprising:

a liquid crystal display panel in which a plurality of liquid crystal pixels are connected to a source line via pixel switching elements; and a display control circuit which performs non-video signal writing for driving the source line according to a non-video signal and applying the potential of the source line to one of the liquid crystal pixels via a selected one of the pixel switching elements and performs video signal writing for driving the source line according to a video signal after the non-video signal writing and applying the potential of the source line to one of the liquid crystal pixels via a selected one of the pixel switching elements;

wherein the display control circuit is configured to provide a precharge period between a non-video signal writing period in which the non-video signal writing is performed and a video signal writing period in which the video signal writing is initially performed after the non-video signal writing period and transition the potential of the source line to a level which is close to an intermediate gradation display level corresponding to the video signal in the precharge period.

* * * * *